US007745088B2

(12) United States Patent
Yoshizaki et al.

(10) Patent No.: US 7,745,088 B2
(45) Date of Patent: Jun. 29, 2010

(54) NON-MAGNETIC TONER

(75) Inventors: Kazumi Yoshizaki, Suntou-gun (JP); Koji Inaba, Hadano (JP); Yasushi Katsuta, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/268,767

(22) Filed: Nov. 11, 2008

(65) Prior Publication Data

US 2009/0186290 A1 Jul. 23, 2009

Related U.S. Application Data

(63) Continuation of application No. PCT/JP2008/063029, filed on Jul. 18, 2008.

(30) Foreign Application Priority Data

Jul. 19, 2007 (JP) ..... 2007-188270

(51) Int. Cl.
*G03G 9/08* (2006.01)

(52) U.S. Cl. ..... 430/110.2; 430/109.3; 430/108.1; 430/111.4

(58) Field of Classification Search ..... 430/111.4, 430/109.3, 123.53, 110.2
See application file for complete search history.

(56) References Cited

U.S. PATENT DOCUMENTS

| | | | | |
|---|---|---|---|---|
| 5,955,234 | A * | 9/1999 | Matsunaga et al. | 430/109.3 |
| 6,316,157 | B1 | 11/2001 | Yoshikawa et al. | 430/110 |
| 6,413,691 | B2 * | 7/2002 | Daimon et al. | 430/123.53 |
| 6,586,147 | B2 * | 7/2003 | Iida et al. | 430/123.53 |
| 6,740,462 | B2 * | 5/2004 | Bartscher et al. | 430/123.53 |
| 7,001,701 | B2 * | 2/2006 | Fujii et al. | 430/123.53 |
| 7,172,844 | B2 * | 2/2007 | Umemura et al. | 430/123.53 |
| 7,517,627 | B2 * | 4/2009 | Kashiwabara et al. | 430/109.3 |
| 2002/0051924 | A1 * | 5/2002 | Iida et al. | 430/109.3 |
| 2004/0234878 | A1 | 11/2004 | Miyazaki et al. | 430/108.1 |
| 2006/0134543 | A1 * | 6/2006 | Kashiwabara et al. | 430/109.3 |
| 2006/0166120 | A1 * | 7/2006 | Moriki et al. | 430/109.3 |

FOREIGN PATENT DOCUMENTS

| | | |
|---|---|---|
| JP | 09-034163 | 2/1997 |
| JP | 2002-258514 | 9/2002 |
| JP | 2003-053761 | 2/2003 |
| JP | 2004-151638 | 5/2004 |
| JP | 2004-333968 | 11/2004 |

* cited by examiner

*Primary Examiner*—Christopher RoDee
(74) *Attorney, Agent, or Firm*—Fitzpatrick, Cella, Harper & Scinto

(57) ABSTRACT

Provided is anon-magnetic toner including toner particles each containing at least a binder resin, a colorant, and a wax component, and an inorganic fine powder, in which: (1) when a temperature in a temperature range of 50 to 80° C. at which a loss tangent (tan δ) shows a maximum is represented by T1, a storage elastic modulus of the toner at the temperature T1 (G'(T1)) satisfies a relationship of $5.00\times10^7 \leqq G'(T1) \leqq 1.00\times10^9$ (dN/m$^2$); (2) a continuous temperature range with a width of 15° C. or more in which the loss tangent (tan δ) is 0.80 to 2.00 is present in the temperature range of 50 to 80° C.; and (3) the loss tangent (tan δ) is 1.00 or more in a temperature range of 120 to 160° C.

10 Claims, 9 Drawing Sheets

NON-MAGNETIC TONER

BACKGROUND OF THE INVENTION

1. Field of the Invention

The present invention relates to a non-magnetic toner for use in a recording method using an electrophotographic method, an electrostatic recording method, a toner jet method, or the like.

2. Description of the Related Art

In recent years, it has been strongly demanded that an electrophotographic apparatus such as a printer apparatus perform printing at an increased speed and be run at a reduced cost while achieving improvements in definition and quality of an image, and energy savings to an extent larger than the conventional one.

In association with such demand, characteristics requested of toner have become more and more sophisticated, and have covered a broader spectrum. Accordingly, attempts based on various viewpoints have been made on the development of the toner.

From the viewpoints of improvements in definition and quality of an image, a reduction in size of each particle of toner has been demanded in association with an increase in resolution of an image-forming machine up to, for example, 1,200 or 2,400 dpi. Production based on a polymerization method has been proposed as one method of producing the toner containing particles each having a reduced size. The toner based on the polymerization method is specifically obtained by the following method: a method involving the step of subjecting emulsified (agglomerated) resin particles and colorant particles to agglomeration and melt adhesion to prepare an amorphous toner (emulsified (agglomerated) toner) or a method of preparing toner particles (suspension polymerization toner) involving the steps of dispersing a radical polymerizable monomer and a colorant and subjecting the resultant to suspension polymerization by dispersing the droplets of the resultant in an aqueous medium or the like to obtain the toner having a desirable particle diameter so that toner particles are prepared.

In particular, in the case of the production of toner particles by the suspension polymerization method, each particle can be reduced in size with ease, and, furthermore, the resultant toner obtains uniform triboelectric charging performance because the toner shows a sharp particle size distribution and has a high sphericity, and the quality of a material for the surface of the toner becomes substantially uniform. As a result, a toner having high developing performance and high transferring performance can be obtained. In addition, a classifying step can be simplified because a sharp particle size distribution can be obtained as described above. Accordingly, the production of toner particles by the suspension polymerization method is preferable because of a large energy-saving effect, a large shortening effect on a time required for the production, a large improving effect on a yield in each step, and a large reducing effect on a cost for the production, from the viewpoint of a reduction in running cost.

Further, colorization has abruptly advanced in the field of electrophotography. Since a color image is generally formed by development with four kinds of color toners, that is, yellow, magenta, cyan, and black toners which are appropriately superimposed, each color toner is requested to have a higher developing characteristic than that in the case where the toner is used for the formation of a monochromatic image. That is, a toner having the following characteristics has been requested: an electrostatic image can be faithfully developed with the toner, the toner is transferred onto a transfer material such as paper with reliability while being prevented from scattering, and the toner is easily fixed to the transfer material. Such toner produced by the suspension polymerization method as described above is suitable from such viewpoint as well.

The development of a toner that is easily fixed to a transfer material such as paper at low temperatures has been demanded from an energy-saving viewpoint. In association with an improvement in resolution of an image, the control of the gloss value of the image upon formation of the image has been requested simultaneously with the above demand in order that the quality of the image may be brought close to that of a photograph or print. Further, in the formation of a color image, good color mixing performance and good color reproducibility over a wide range have been requested. For example, the acquisition of an image having such a high gloss value that the quality of the image is close to that of a photograph has been requested.

To cope with such request, the glass transition point (Tg) of a binder resin to be used in toner must be lowered, or the average molecular weight of the binder resin to be used in the toner must be lowered. However, in extreme cases, merely lowering the Tg or average molecular weight of the binder resin to be used in the toner impairs the storage stability of the toner to such an extent that an image cannot be obtained. In addition, particularly at the time of high-speed development or in the case of a non-magnetic, one-component developing system suitably applicable to a small apparatus with a low running cost, the toner is apt to collapse owing to a reduction in strength of the toner, so the contamination of a member due to the melt adhesion of the toner or to the exudation of a wax in the toner is apt to occur. As a result, it may become impossible to achieve the following object: an image-forming apparatus with a long lifetime and a low running cost. That is, when improving the fixing characteristic of the toner is simply attempted, the developing characteristic of the toner is impaired. In contrast, when the developing characteristic precedes the fixing characteristic, it may be impossible to improve the fixing characteristic. Although a reduction in average particle diameter of the toner is indeed effective means particularly from the viewpoints of improvements in definition and quality of an image as described above, the means unfortunately promotes the contamination of a member due to the melt adhesion of the toner or to the exudation of the wax, thereby making it additionally difficult to achieve compatibility between the low-temperature fixability and developing characteristic of the toner.

The achievement of compatibility between such properties of toner apparently contradictory to each other, that is, development stability and low-temperature fixability is an important problem which the toner is requested to tackle, and various proposals have been heretofore made on the problem.

For example, there has been proposal focused on the viscoelastic characteristics where viscoelastic characteristics in each of two temperature regions, that is, the temperature region of 60 to 80° C. and the temperature region of 130 to 190° C. can achieve the compatibility between low-temperature fixability and offset resistance (see Patent Document 1 and Patent Document 2).

Further, there has been disclosed that the compatibility between an additional improvement in fixability and developability can be achieved by specifying the local maximum value and local minimum value of a loss tangent (tan δ) as a ratio between a storage elastic modulus (G') and a loss elastic modulus (G") for the viscoelastic characteristics of toner (see Patent Document 3 and Patent Document 4).

However, each conventionally proposed technology is still susceptible to improvement in terms of the following point: while good fixing performance and high gloss are maintained, such damage to toner as described above is alleviated, and, for example, even when an increase in temperature inside a contact developing system due to continuous paper feeding in the system occurs, stable developing performance is obtained over a long time period.

[Patent Document 1] JP 09-34163 A
[Patent Document 2] JP 2004-333968 A
[Patent Document 3] JP 2004-151638 A
[Patent Document 4] JP 2004-264484 A

SUMMARY OF THE INVENTION

The present invention aims to solve the above-mentioned problems of the conventional art.

(1) That is, an object of the present invention is to provide a non-magnetic toner capable of providing a high-resolution, high-definition image.

(2) Another object of the present invention is to provide a non-magnetic toner excellent in low-temperature fixability and capable of providing an image having a gloss value and an image density needed for bringing the quality of the image close to that of a photograph or print while achieving the object in the above section (1).

(3) Still another object of the present invention is to provide a non-magnetic toner capable of suppressing the occurrence of the contamination of a member irrespective of an environment under which image output is performed and excellent in durability while achieving the object in the above section (1)

(4) Still another object of the present invention is to provide a non-magnetic toner showing quick rise-up of charging and having a sharp charge quantity distribution, high developing performance, and high transferring performance.

(5) Still another object of the present invention is to provide a non-magnetic toner capable of suppressing the occurrence of blocking when the toner is left to stand at high temperatures and excellent in storage stability.

The inventors of the present invention have made extensive studies. As a result, the inventors have found that the above-mentioned problems can be solved by the following constitution. Thus, the inventors have arrived at the present invention.

That is, the present invention relates to a non-magnetic toner including toner particles each containing at least a binder resin, a colorant, and a wax component, and an inorganic fine powder, in which:

(1) when a temperature in a temperature range of 50 to 80° C. at which a loss tangent (tan δ) as a ratio of a loss elastic modulus (G") of the toner to a storage elastic modulus (G') of the toner shows a maximum is represented by T1, a storage elastic modulus of the toner at the temperature T1 (G'(T1)) ($dN/m^2$) satisfies a relationship of $5.00\times10^7 \leqq G'(T1) \leqq 1.00\times10^9$;

(2) a continuous temperature range with a width of 15° C. or more in which the loss tangent (tan δ) as a ratio of the loss elastic modulus (G") of the toner to the storage elastic modulus (G') of the toner is 0.80 to 2.00 is present in the temperature range of 50 to 80° C.; and (3) the loss tangent (tan δ) as a ratio of the loss elastic modulus (G") of the toner to the storage elastic modulus (G') of the toner is always 1.00 or more in a temperature range of 120 to 160° C.

The non-magnetic toner of the present invention has low-temperature fixability, and each particle of the toner has high toughness. Accordingly, the toner hardly causes the contamination of a member, shows a small change in its triboelectric charging characteristic, and is excellent in long-term durability. In addition, the toner is excellent in transferring performance, and can provide a high-definition, high-quality image.

Further features of the present invention will become apparent from the following description of exemplary embodiments (with reference to the attached drawings).

Figure 1:
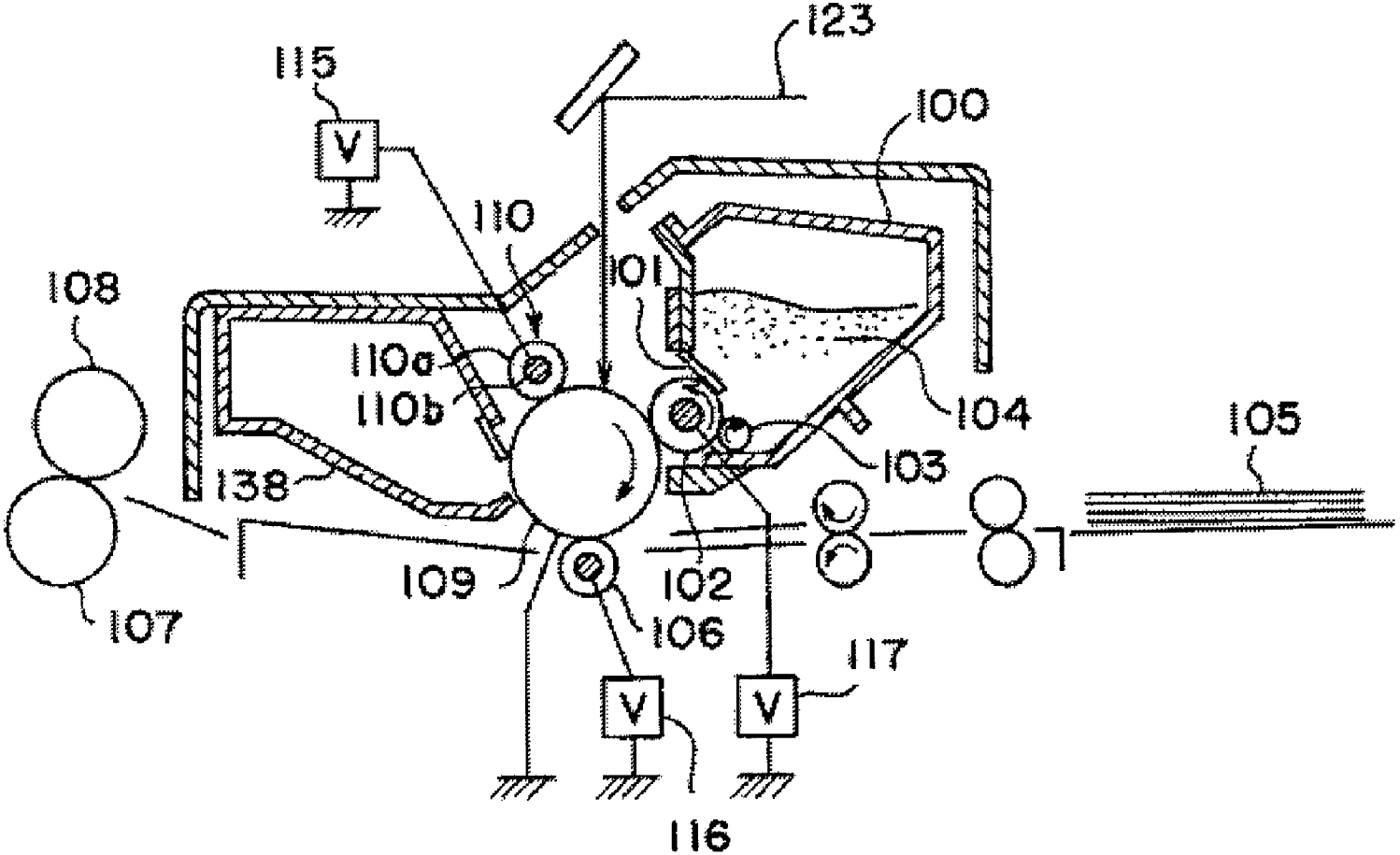
FIG. 1 is an outline view showing an example of an image-forming apparatus to which a toner of the present invention is applicable.

1 photosensitive drum
2 charging roller
4Y yellow developing assembly
4M magenta developing assembly
4C cyan developing assembly
4Bk black developing assembly
5 intermediate transfer drum
5*a* conductive support
5*b* elastic layer
6 cleaner
8 transfer member
9 fixing apparatus
9*a* heat roller
9*b* pressure roller
24 rotary unit
17*a*, 17*b*, 17*c*, 17*d* developing means
18*a*, 18*b*, 18*c*, 18*d* cleaning means
19*a*, 19*b*, 19*c*, 19*d* photosensitive drum
20 eliminating unit
22 fixing unit
23*a*, 23*b*, 23*c*, 23*d* latent image-forming means
24*a*, 24*b*, 24*c*, 24*d* transferring means
25 belt
26 discharge port
29*a*, 29*b*, 29*c*, 29*d* image-forming portion
30*a*, 30*b*, 30*c*, 30*d* charging means
100 developing assembly
101 developing blade
102 toner carrying member
103 applying roller
104 toner

105 transfer body
106 transfer member
107 pressure roller for fixation
108 heat roller for fixation
109 photosensitive member
110 primary charging member (charging roller)
123 exposure
138 cleaner
241 photosensitive member
242 charging roller
242*a* conductive elastic layer
242*b* core mandrel
243 exposure
244-1, 244-2, 244-3, 244-4 developing assembly
245 intermediate transfer drum
245*a* elastic layer
245*b* conductive support
246 transfer material
247 transfer belt
247*a* bias roller
247*a*1 conductive elastic layer
247*a*2 core mandrel
247*c* tension roller
247*d* secondary power supply transfer bias source
248 cleaning blade
249 cleaning means
280 cleaning means
281 fixing unit
309 charging member for cleaning
310 intermediate transfer belt
311 transfer roller
312 primary transfer roller
313*a* secondary transfer opposite roller
313*b* secondary transfer roller
314, 315, 316 bias power supply
410 fixing belt
416*a*, 416*b* film (belt) guide member
417*a*, 417*b*, 417*c* magnetic core
418 excitation coil
419 insulating member (excitation coil bearing member)
422 tough stay for pressure
426 temperature sensor
430 pressure roller (elasticity)
430*a* core mandrel
430*b* elastic material layer
440 good heat conduction member
450 thermometal cut-out
N fixing nip
P transfer material (recording material)

DESCRIPTION OF THE EMBODIMENTS

Hereinafter, the present invention is described in detail with reference to embodiments of the present invention.

The non-magnetic toner of the present invention (hereinafter, referred to merely "toner" in some cases) includes toner particles each containing at least a binder resin, a colorant, and a wax component, and an inorganic fine powder, in which:

(1) when a temperature in a temperature range of 50 to 80° C. at which a loss tangent (tan δ) as a ratio of a loss elastic modulus (G") of the toner to a storage elastic modulus (G') of the toner shows a maximum is represented by T1, a storage elastic modulus of the toner at the temperature T1 (G'(T1)) (dN/m$^2$) satisfies a relationship of $5.00\times10^7 \leqq G'(T1) \leqq 1.00\times10^9$;

(2) a continuous temperature range with a width of 15° C. or more in which the loss tangent (tan δ) as a ratio of the loss elastic modulus (G") of the toner to the storage elastic modulus (G') of the toner is 0.80 to 2.00 is present in the temperature range of 50 to 80° C.; and (3) the loss tangent (tan δ) as a ratio of the loss elastic modulus (G") of the toner to the storage elastic modulus (G') of the toner is always 1.00 or more in a temperature range of 120 to 160° C.

In particular, the above toner has the following large characteristic: a continuous temperature range with a width of 15° C. or more in which the loss tangent (tan δ) as a ratio of the loss elastic modulus (G") of the toner to the storage elastic modulus (G') of the toner is 0.80 to 2.00 (value around 1) is present in the temperature range of 50 to 80° C. The width is more preferably 20° C. or more. The foregoing means that the storage elastic modulus (G') and the loss elastic modulus (G") show similar values in the temperature region. In other words, the foregoing means that the temperature range in which the amounts of the elastic and viscous components of the toner are balanced is broad. The inventors have found that the foregoing is correlated with the following: the contamination of a member can be suppressed, uniform triboelectric charging of the surface of the toner can be promoted, the occurrence of image defects such as fogging and scattering can be suppressed, and, furthermore, the transferring performance of the toner can be improved to such an extent that the toner can provide high-definition, high-quality images over a long time period; a significant correlation is observed particularly in image output under a high-temperature environment.

Although the mechanism via which such correlation arises is unclear, the inventors of the present invention consider the mechanism to be as described below.

First, the above temperature range of 50 to 80° C. is a temperature region which the temperature of the surface of each of a toner carrying member, a photosensitive member, and any member around them may reach particularly when images are continuously formed under a high-temperature environment, and the toner is subjected to a developing step in the temperature region.

The case where a continuous temperature range with a width of 15° C. or more in which the above loss tangent (tan δ) is 0.80 to 2.00 is not present in the above temperature range of 50 to 80° C. because a temperature range in which the loss tangent (tan δ) shows a value of less than 0.80 is broad means that a temperature region where the elastic component of each particle of the toner is dominant is broad. In this case, a temperature region where the deformation of the toner is suppressed is broad, and the toner and a charging member are apt to show point contact in the temperature region. As a result, the surface of the toner is not subjected to uniform triboelectric charging, and image defects such as fogging and scattering are apt to occur. In addition, an external additive is apt to be liberated from the toner, and the contamination of a member is apt to occur owing to the liberated external additive.

The case where a continuous temperature range with a width of 15° C. or more in which the above loss tangent (tan δ) is 0.80 to 2.00 is not present in the above temperature range of 50 to 80° C. because a temperature range in which the loss tangent (tan δ) shows a value in excess of 2.00 is broad means that a temperature region where the viscous component of each particle of the toner is dominant is broad. That is, a temperature region where the toner easily deforms is broad, so the surface of the toner is easily subjected to uniform triboelectric charging in a charging step. However, the toner has weak power to return to its original state after certain deformation. Accordingly, upon transfer of a toner image developed on a photosensitive member, an area of contact between the toner and the photosensitive member becomes wide, so the transferring performance of the toner is apt to reduce. In addition, when the toner composed of fine particles is used with a view to achieving high definition or when the toner is used under a stringent developing condition, in other words, for image output in a high-speed machine, the contamination of a member is apt to be promoted, and the long-term durability of the toner is apt to reduce.

When the temperature in the above temperature range of 50 to 80° C. at which the loss tangent (tan δ) as a ratio of the loss elastic modulus (G") of the non-magnetic toner of the present invention to the storage elastic modulus (G') of the toner shows a maximum is represented by T1, the storage elastic modulus of the above toner at the above temperature T1 (G'(T1)) is $5.00\times10^7$ dN/m$^2$ or more and $1.00\times10^9$ dN/m$^2$ or less.

The case where the storage elastic modulus (G'(T1)) of the toner is less than $5.00\times10$/dN/m$^2$ means that the absolute amount of the elastic component in each particle of the toner is small. As a result, the melt adhesion of the toner to a charge-providing member or to a control member is apt to occur owing to an influence of an increase in temperature inside a developing assembly. On the other hand, the case where the storage elastic modulus (G'(T1)) at the above temperature T1 exceeds $1.00\times10^9$ dN/m$^2$ means that the absolute amount of the elastic component in each particle of the toner is large. As a result, the surface of the toner is hardly subjected to uniform triboelectric charging, and image defects such as fogging and scattering are apt to occur. In addition, the external additive is apt to be liberated from each particle of the toner, and the contamination of a member is apt to occur owing to the liberated external additive. The storage elastic modulus (G'(T1)) is more preferably $5.00\times10^7$ dN/m$^2$ or more and $5.00\times10^8$ dN/m$^2$ or less.

Next, the reason why the loss tangent (tan δ) as a ratio of the loss elastic modulus (G") of the above toner to the storage elastic modulus (G') of the toner must be 1.00 or more in the temperature range of 120 to 160° C. will be described.

The above temperature range of 120 to 160° C. is a temperature region which a fixing unit reaches upon image formation, and the toner is subjected to a fixing step in the temperature region.

The loss tangent (tan δ) as a ratio of the loss elastic modulus (G") of the non-magnetic toner of the present invention to the storage elastic modulus (G') of the above toner is always 1.00 or more in the above temperature range of 120 to 160° C. The case where the loss tangent (tan δ) is less than 1.00 means that the elastic component is excessively dominant. In this case, the toner hardly deforms, and adheres weakly to a transfer material, so it becomes difficult to form images each having high gloss stably while the offset resistance of the toner is maintained. That is, the toner is poor in low-temperature fixability, which is one object of the present invention.

In addition, in the present invention, the loss tangent of the toner at the temperature T1 in the temperature range of 50 to 80° C. at which the loss tangent (tan δ) as a ratio of the loss elastic modulus (G") to the storage elastic modulus (G') shows a maximum (tan δ(T1)) preferably satisfies the relationship of $1.00\leqq\tan\delta(T1)\leqq2.00$. When the above loss tangent (tan δ(T1)) falls within the above range, the surface of the toner is subjected to uniform triboelectric charging, and image defects such as fogging and scattering can be suppressed in an additionally favorable fashion. In addition, the liberation of the external additive from each particle of the toner can be suppressed, and the contamination of a member resulting from the liberated external additive can be suppressed. Further, the toner can obtain good transferring performance, and, even when the toner composed of fine particles is used with a view to achieving high definition or when the toner is used under a stringent developing condition, in other words, for image output in a high-speed machine, the contamination of a member can be favorably suppressed, and the toner can obtain excellent durability.

In addition, in the present invention, when the temperature in the above temperature range of 120 to 160° C. at which the loss tangent (tan δ) of the toner shows a maximum is represented by T2, the loss tangent of the above toner at the above temperature T2 (tan δ(T2)) preferably satisfies the relationship of $1.50\leqq\tan\delta(T2)\leqq4.50$, and the storage elastic modulus of the toner at the above temperature T2 (G'(T2)) is preferably $1.00\times10^3$ dN/m$^2$ or more and $1.00\times10^5$ dN/m$^2$ or less.

When the loss tangent (tan δ(T2)) falls within the above range, an appropriate balance is established between the adhesive force of the toner for a transfer material and the adhesive force of the toner for a fixing member, and the toner obtains particularly good offset resistance, so an image having a high gloss value can be easily formed. The loss tangent (tan δ(T2)) is more preferably 1.50 or more and 4.00 or less.

In addition, when the above storage elastic modulus (G'(T2)) falls within the above range, the amount of the elastic component in each particle of the toner becomes proper. Accordingly, an appropriate balance is established between the adhesive force of the toner for a transfer material and the adhesive force of the toner for a fixing member, and compatibility between the maintenance of offset resistance and the formation of an image having a high gloss value can be favorably achieved. The storage elastic modulus (G'(T2)) is more preferably $1.00\times10^3$ dN/m$^2$ or more and $5.00\times10^4$ dN/m$^2$ or less.

A method of obtaining a toner having such viscoelastic characteristics as described above is, for example, as follows: while the glass transition point (Tg) of a binder resin of which the inner layer of a toner particle is formed is lowered or the peak molecular weight (Mp) of the resin is lowered, a polar resin having a high Tg or Mp to serve as the outer layer of the toner particle is caused to be present in a sufficient amount so that toner particles each having a core/shell structure are obtained.

Some of the toner particles each of which is of such a type as to have the above core/shell structure are each separated into an inner layer and an outer layer. Such particles each have an excellent function because the outer layer is used mainly for protecting a component in the inner layer. However, adhesiveness between the inner layer and the outer layer is weak, so, when the toner continuously receives a stress in continuous output, the outer layer peels or is shaved, and the surface composition of each particle of the toner may abruptly change at a certain time point. Accordingly, it becomes difficult to provide high reliability for the developing performance or transferring performance of the toner. In the present invention, the following procedure is considered to be important: an outer layer is formed by using a resin having polarity and compatibility with a binder resin simultaneously as a shell binder while adhesiveness between the outer layer and an inner layer is sufficiently secured.

The storage elastic modulus G' and loss elastic modulus G" of the toner in the present invention are each measured by typical dynamic viscoelasticity measurement, and the loss tangent (tan δ) is calculated by dividing the loss elastic modulus (G") by the storage elastic modulus (G') (tan δ=G"/G').

For example, in the present invention, the moduli were determined by the following method.

A rotary flat plate rheometer (trade name: ARES, manufactured by TA INSTRUMENTS) is used as a measuring apparatus. A toner molded into a disk having a diameter of 7.9 mm and a thickness of 2.0±0.3 mm under pressure by using a pellet molder at a temperature of 25° C. is used as a measurement sample. The sample is mounted on the parallel plate of the measuring apparatus, and its temperature is increased from room temperature (25° C.) to a temperature of 105° C. within 15 minutes so that the shape of the disk is adjusted. After the sample has been cooled to the temperature at which viscoelasticity measurement is initiated, the measurement is initiated.

The measurement is performed under the following conditions.

(1) A parallel plate having a diameter of 7.9 mm is used.

(2) The Frequency is set to 1.0 Hz.

(3) The Fluid Density is set to 1.0 g/cm$^3$.

(4) The Fixture Compliance is set to 0.83 μrad/g·cm.

(5) The Strain is set to 0.02%.

(6) Measurement is performed in the temperature range of 35 to 200° C. at a Ramp Rate of 2.0° C./min.

(7) The Max Applied Strain is set to 20.0%.

(8) The Max Allowed Torque is set to 150.0 g·cm, and the Min Allowed Torque is set to 1.0 g·cm.

(9) The Strain Adjustment is set to 20.0% of Current Strain.

(10) The Auto Tension Direction is set to Tension.

(11) The Initial Static Force is set to 10.0 g, and the Auto Tension Sensitivity is set to 40.0 g.

(12) The condition under which the Auto Tension operates is such that the Sample Modulus is $1.0\times10^7$ Pa or more.

(13) Measurement data is taken at an interval of 30 seconds.

The melt viscosity of the above toner of the present invention at 100° C. measured with a flow tester is preferably $5.00\times10^3$ to $2.00\times10^4$ Pa·s. When the melt viscosity of the toner at a temperature of 100° C. measured with a flow tester falls within the above range, the wax exudes to an appropriate extent, and the toner obtains additionally good hot offset resistance. In addition, the toner maintains moderate toughness, so the developing performance and transferring performance of the toner become additionally good. Further, the adhesive force of the toner for transfer paper becomes moderate, so the toner obtains additionally good effects in terms of low-temperature fixability and winding resistance as well. In addition, the ease with which a fixed image having a high gloss value is obtained is improved.

The melt viscosity of the toner at 100° C. is more preferably $5.00\times10^3$ to $1.80\times10^4$ Pa·s.

The melt viscosity of the toner in the present invention is measured by the following method.

The melt viscosity in the present invention is the viscosity of the toner at 100° C. measured by a flow tester temperature increase method. Measurement is performed with, for example, a Flow Tester CFT-500D (manufactured by Shimadzu Corporation) as an apparatus under the following conditions.

Sample: 1.1 g of the toner are weighed, and are molded into a sample with a pressure molder.

Die hole diameter: 0.5 mm

Die length: 1.0 mm

Cylinder pressure: $9.807\times10^5$ Pa

Measurement mode: Temperature increase method

Rate of temperature increase: 4.0° C./min

The viscosities of the toner at temperatures of 50 to 200° C. are measured by the above method, and the melt viscosity of the toner at 100° C. is determined. It should be noted that the above melt viscosity can satisfy the condition by adjusting the molecular weight or glass transition temperature of the binder resin or by adjusting the kind and content of the wax component. In addition, in the case of a polymerized toner as a preferred embodiment of the present invention, the melt viscosity can be controlled depending on polymerization conditions (a temperature, and the kind and amount of an initiator).

The toner in the present invention has an average circularity measured with a flow-type particle image analyzer of preferably 0.960 to 0.995. When the average circularity falls within the above range, the toner can obtain good transferring performance. In addition, a flowability improver (external additive) can be caused to adhere to the surface of each particle of the toner in an additionally uniform state, so the toner can be favorably transferred onto even a transfer material having low smoothness. The average circularity of the toner is more preferably 0.970 to 0.995. It should be noted that the average circularity of the toner can satisfy the condition by adjusting the temperature of an environment where the toner is produced at the time of the production of the toner. In addition, in the case of a polymerized toner as a preferred embodiment of the present invention, the average circularity can satisfy the condition by adjusting the amount in which a dispersion stabilizer is loaded.

The average circularity of toner of the present invention is measured with a flow-type particle image analyzer. The measurement principle of the flow-type particle image analyzer "FPIA-3000 type" (manufactured by SYSMEX CORPORATION) is as follows: flowing particles are photographed as a static image, and the image is analyzed. A sample added to a sample chamber is transferred to a flat sheath flow cell with a sample sucking syringe. The sample transferred to the flat sheath flow cell is sandwiched between sheath liquids to form a flat flow. The sample passing through the inside of the flat sheath flow cell is irradiated with stroboscopic light at an interval of 1/60 second, whereby flowing particles can be photographed as a static image. In addition, the particles are photographed in focus because the flow of the particles is flat. A particle image is photographed with a CCD camera, and the photographed image is subjected to image processing at an image processing resolution of 512×512 pixels (each measuring 0.37 μm by 0.37 μm), whereby the border of each particle image is sampled. Then, the projected area, perimeter, and the like of each particle image are measured.

An image signal is subjected to A/D conversion in an image processing portion and captured as image data, and stored image data is subjected to image processing for judging whether a particle is present.

Figure 8:
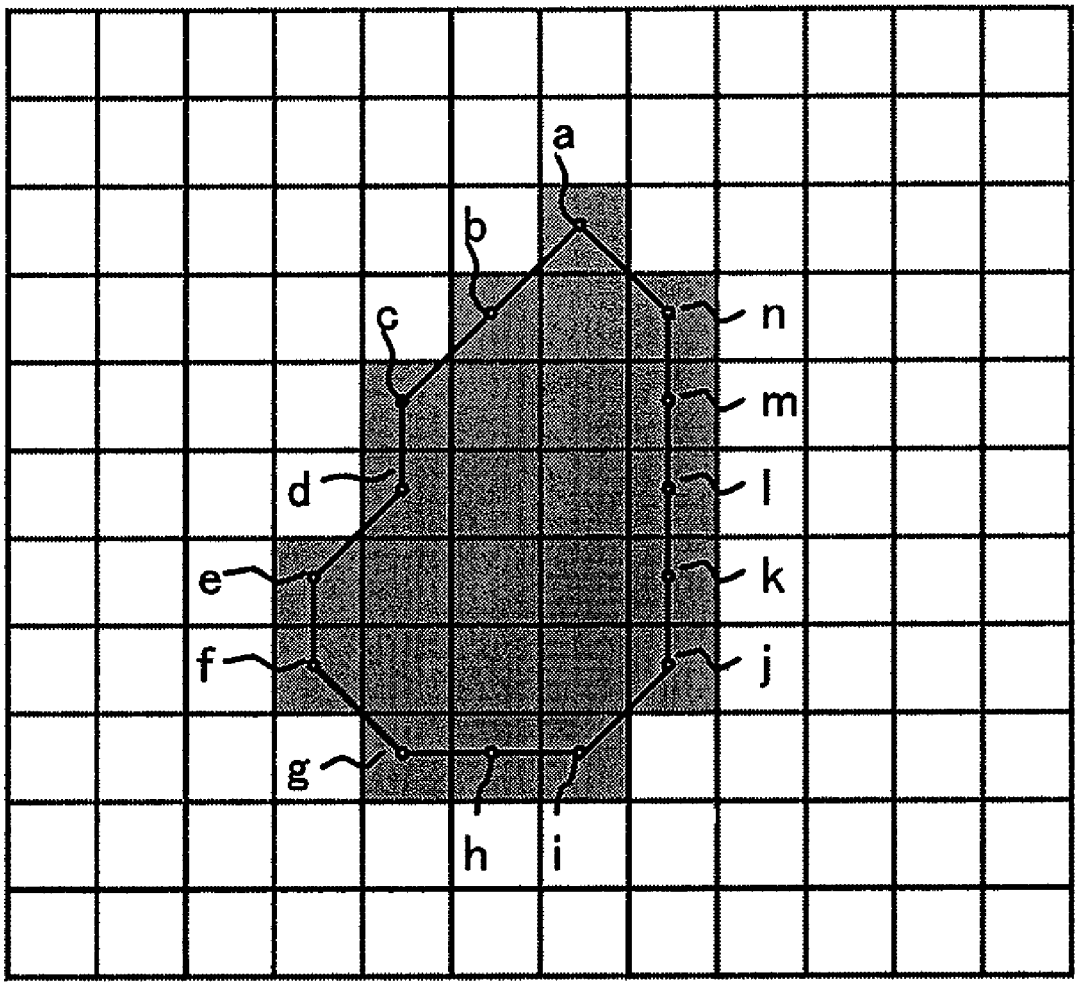
FIG. 8 is an example of a binarized image of a particle measured with an FPIA-3000.
Figure 9:
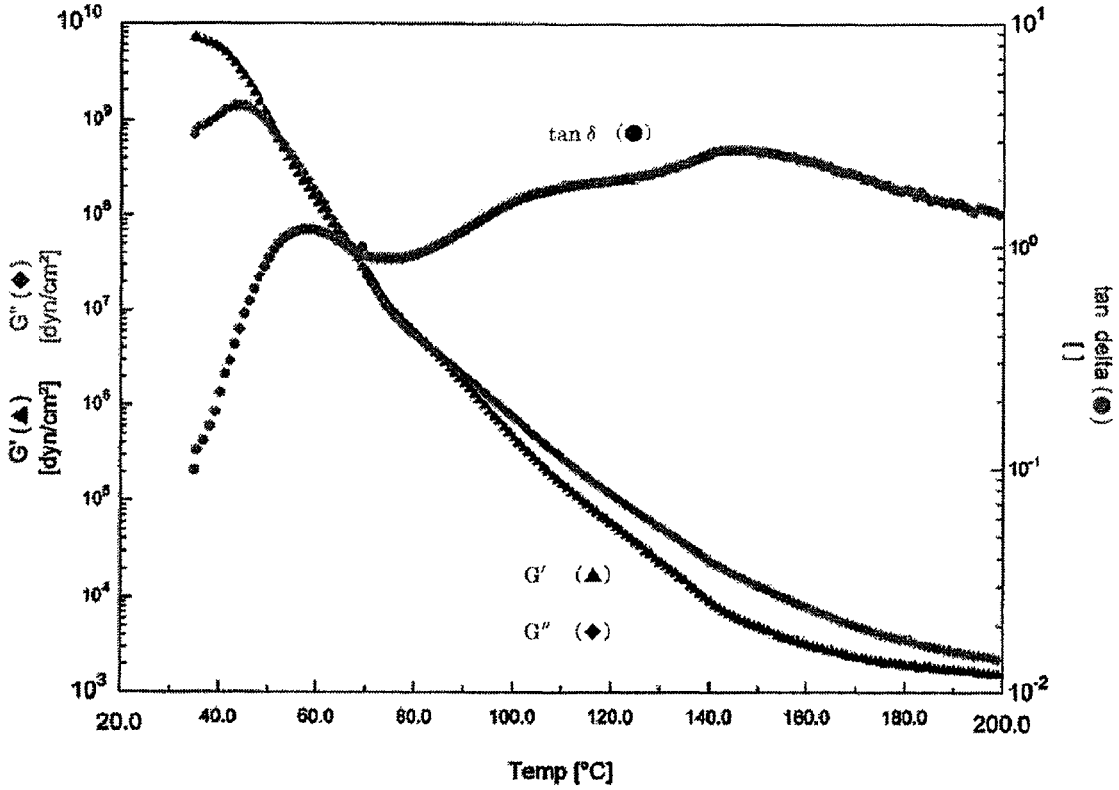
FIG. 9 shows an example of each of the storage elastic modulus curve, loss elastic modulus curve, and tan(δ) curve of the toner of the present invention.

Next, an edge enhancing treatment as a pretreatment for appropriately sampling the edge of each particle image is performed. Then, image data is binarized at a certain appropriate threshold level. When image data is binarized at a certain appropriate threshold level, each particle image becomes such binarized image as shown in FIG. 8. Next, judgment as to whether each binarized particle image is an edge point (edge pixel representing an edge) is made, and information about the direction in which an edge point adjacent to the edge point of interest is present, that is, a chain code is prepared.

Next, projected area S of each measured particle image and the perimeter L of a particle projected image are measured. With the value for area S and perimeter L, a circle-equivalent diameter and a circularity are determined. The circle-equivalent diameter is defined as the diameter of a circle having the same area as that of the projected area of a particle image, the circularity C is defined as a value obtained by dividing the perimeter of a circle determined from the circle-equivalent diameter by the perimeter of a particle projected image, and the circularity are calculated from the following equations.

$$C=2\times(\pi S)^{1/2}/L \quad \text{[Ex. 1]}$$

When a particle image is of a complete round shape, the circularity of the particle in the image becomes 1.000. With an increase in a perimeter unevenness degree of the particle image, the circularity of the particle decreases. After the circularities of the respective particles have been calculated, the circularities are obtained by dividing a circularity range of 0.2 to 1.0 into 800 sections. An arithmetic average is calculated by using the central value of each divided points and the number of measured particles so that the average circularity is calculated.

A specific measurement method is as described below. 10 ml of ion-exchanged water from which an impurity solid has been removed in advance are prepared in a container. A surfactant (preferably an alkylbenzene sulfonate) is added as a dispersant to ion-exchanged water, and, furthermore, 0.02 g of a measurement sample is added to and uniformly dispersed in the mixture. The dispersion treatment is performed for 5 minutes with an ultrasonic dispersing unit UH-50 model (manufactured by MST) mounted with a titanium alloy tip having a diameter of 5 mm as an oscillator, whereby a dispersion liquid for measurement is obtained. At that time, the dispersion liquid is appropriately cooled so as not to have a temperature of 40° C. or higher.

The flow-type particle image analyzer mounted with a standard objective lens (at a magnification of 10) was used for measurement, and a particle sheath "PSE-900A" (manufactured by SYSMEX CORPORATION) was used as a sheath liquid. The dispersion liquid prepared in accordance with the above procedure was introduced into the flow-type particle image analyzer, and 3,000 toner particles were measured according to a total count mode using a HPF measurement mode. The average circularity of the toner was determined by setting a binarization threshold to 85% and limiting particle diameters to be analyzed to ones each corresponding to a circle-equivalent diameter of 2.00 μm or more to 200.00 μm or less upon the particle analysis.

When the circle-equivalent diameter is determined, prior to the initiation of the measurement, automatic focusing is performed by using standard latex particles (obtained by diluting, for example, 5200A manufactured by Duke Scientific with ion-exchanged water). After that, focusing is preferably performed every two hours from the initiation of the measurement.

It should be noted that, in each example of the present application, a flow-type particle image analyzer which had been subjected to a calibration operation by SYSMEX CORPORATION, and which had received a calibration certificate issued by SYSMEX CORPORATION was used, and the measurement was performed under measurement and analysis conditions identical to those at the time of the reception of the calibration certificate except that particle diameters to be analyzed were limited to ones each corresponding to a circle-equivalent diameter of 2.00 μm or more to 200.00 μm or less.

The toner in the present invention has a weight average particle diameter (D4) of preferably 4.0 to 9.0 μm from the viewpoint of the acquisition of a high-definition, high-quality image. When the weight average particle diameter falls within the above range, the contamination of a member can be suppressed in an additionally favorable fashion, and the toner can obtain good dot reproducibility. The weight average particle diameter of the toner is more preferably 4.0 to 8.0 μm.

The weight average particle diameter (D4) can be measured with an apparatus such as a Coulter Counter TA-II model or a Coulter Multisizer (each manufactured by Beckman Coulter, Inc). To be specific, the weight average particle diameter can be measured as described below. An interface (manufactured by Nikkaki Bios Co., Ltd.) and a PC9801 personal computer (manufactured by NEC Corporation) for outputting a number distribution and a volume distribution are connected by means of a Coulter Multisizer (manufactured by Beckman Coulter, Inc), and a 1% aqueous solution of NaCl is prepared as an electrolyte solution with extra-pure sodium chloride For example, an ISOTON R-II (manufactured by Coulter Scientific Japan, Co.) can be used. The procedure of the measurement is as follows.

100 to 150 ml of the electrolyte aqueous solution are added, and 2 to 20 mg of a measurement sample are added. The electrolyte solution into which the sample has been suspended is subjected to a dispersion treatment by using an ultrasonic dispersing device for about 1 to 3 minutes. The volume and number of toner particles each having a diameter of 2.0 μm or more are measured with the Coulter Multisizer by using a 100-μm aperture to calculate the volume distribution and the number distribution. Then, the weight average particle size (D4) is determined.

It should be noted that the above condition on the weight average particle diameter (D4) of the above toner can be satisfied by adjusting the grain sizes of the particles of the toner in a grain size-adjusting step such as air classification or screening at the time of the production of the toner. In addition, in the case of a polymerized toner as a preferred embodiment of the present invention, the weight average particle diameter can be adjusted depending on the amount in which a dispersion stabilizer is loaded.

The toner of the present invention contains a wax component in an amount of preferably 0.5 to 50 parts by mass, more preferably 3 to 30 parts by mass, or still more preferably 5 parts by mass to 20 parts by mass with respect to 100 parts by mass of a binder resin in order that a good fixed image may be obtained. As long as the content of the wax component falls within the above range, cold offset of the toner can be favorably suppressed while the long-term storage stability of the toner is maintained. In addition, good flowability and good image characteristics can be maintained while the dispersion of any other toner material is not prevented.

Examples of wax components which may be used in the toner of the present invention preferably includes: petroleum waxes such as a paraffin wax, a microcrystalline wax, and petrolactam, and derivatives thereof; a montan wax and derivatives thereof; a hydrocarbon wax according to a Fischer-Tropsch method and derivatives thereof; polyolefin waxes such as a polyethylene wax, polypropylene wax, and derivatives thereof; and natural waxes such as a carnauba wax and a candelilla wax, and derivatives thereof. Those derivatives include oxides, block copolymers with vinyl monomers, and graft modified products. Further, fatty acids such as higher aliphatic alcohols, staric acid, and palmitic acid or compounds thereof, acid amide waxes, ester waxes, ketones, cured castor oils and derivatives thereof, plant waxes, and animal waxes. Of those, an ester wax and a hydrocarbon wax are particularly preferable because each of the waxes is excellent in releasing performance. The wax component more preferably contains compounds identical to each other in total carbon number at a content of 50 to 95 mass % because the wax can show a high purity and an effect of the present invention can be easily exerted from the viewpoint of developing performance.

Of those waxes, one having the highest endothermic peak in a DSC curve measured with a differential scanning calorimeter in the range of 40° C. to 110° C. is preferable, and one having the highest endothermic peak in the range of 45° C. to 90° C. is more preferable. In addition, the half width of the highest endothermic peak is preferably 2 to 15° C., or more preferably 2 to 10° C. The half width of the highest endothermic peak is the temperature width of an endothermic chart at a portion corresponding to one half of the peak height of the endothermic peak from a base line. When the half width falls within the above range, the wax has moderate crystallinity and moderate hardness, so the occurrence of the contamination of a photosensitive member or charging member can be suppressed.

In addition, the toner of the present invention preferably has the highest endothermic peak originating from the melting point of the above wax in the range of 70 to 120° C. in a DSC curve measured with a differential scanning calorimeter.

A DSC curve is determined by means of a differential scanning calorimeter (a DSC measuring device) and a DSC-7 (manufactured by Perkin Elmer Co., Ltd.) in conformity with ASTM D 3418-82. Specifically, it is measured in the following manner.

5 to 20 mg, preferably 10 mg, of measurement sample are precisely weighed.

The sample is charged into an aluminum pan, and measurement is performed in the measurement temperature range of 30 to 200° C. and at a rate of temperature increase of 10° C./min at normal temperature and a normal humidity by using an empty aluminum pan as a reference.

In this heating process, the endothermic main peak in the wax and the maximum endothermic main peak in the toner are obtained.

The main peak molecular weight Mp of the THF soluble matter of the toner in the present invention in GPC is preferably 10,000 to 40,000, or more preferably 15,000 to 35,000. When the main peak molecular weight falls within the above range, the wax exudes to a moderate extent, and the toner obtains good hot offset resistance. In addition, the toner has moderate toughness, so the toner can obtain good developing performance and good transferring performance. Further, the toner obtains an excellent characteristic in terms of low-temperature fixability as well.

It should be noted that the above condition on the main peak molecular weight Mp of the above toner can be satisfied by adjusting the temperature of an environment where the toner is produced at the time of the production of the toner; particularly in the case where the toner is produced by a polymerization method as a preferred production method in the present invention, the condition can be satisfied by adjusting polymerization conditions (a temperature, and the kind and amount of an initiator).

The main peak molecular weight, weight average molecular weight (Mw), and number average molecular weight (Mn) of the THF soluble matter of the toner in the present invention are measured by the following measurement method.

A measurement sample is produced as described below.

The toner as a sample and THF are mixed so that the concentration of the sample in the mixture is about 0.5 to 5 mg/ml (for example, about 5 mg/ml). Then, the mixture is left to stand at room temperature for several hours (for example, 5 to 6 hours). After that, the mixture is sufficiently shaken so that THF and the sample are mixed well with each other (until the coalesced body of the sample disappears). Further, the mixture is subjected to still standing at room temperature for 12 hours or longer (for example, 24 hours). In this case, the time period commencing on the initiation of the mixing of the sample and THF and ending on the completion of the still standing should be 24 hours or longer. After that, the mixture is passed through a sample treatment filter (having a pore size of 0.45 to 0.5 μm, for example, a Maishori Disk H-25-2 manufactured by TOSOH CORPORATION or an Ekicrodisc 25CR manufactured by Gelman Science Japan Co., Ltd. can be preferably utilized), and is regarded as a sample for GPC. The concentration of a resin component in the sample is adjusted to 0.5 to 5 mg/ml (Measurement Conditions)

Apparatus: High speed GPC "HLC8120 GPC" (manufactured by TOSOH CORPORATION)

Column: A series of seven columns Shodex KF-801, 802, 803, 804, 805, 806, and 807 (manufactured by Showa Denko K.K.)

Eluent: THF

Flow rate: 1.0 ml/min

Oven temperature: 40.0° C.

Amount in which sample is injected: 0.10 ml

In addition, upon calculation of the molecular weight of the sample, a molecular weight calibration curve prepared with a standard polystyrene resin (TSK Standard Polystyrene F-850, F-450, F-288, F-128, F-80, F-40, F-20, F-10, F-4, F-2, F-1, A-5000, A-2500, A-1000, or A-500 manufactured by TOSOH CORPORATION) was used as a calibration curve.

The toner in the present invention has a glass transition temperature (Tg) measured with a differential scanning calorimeter of preferably 30 to 58° C., or more preferably 40 to 55° C.

In addition, the same apparatus as that used in the method of obtaining an endothermic peak of the wax is basically used in a method of measuring the Tg of the toner in the present invention. However, in some cases, the DSC melting point peak of the wax and the Tg of the toner overlap at the time of heating. In view of the foregoing, in the toner of the present invention, measurement is performed by using a modulated mode under the following conditions, and the Tg is determined from the position of a peak in a DSC curve for the first temperature increase. It should be noted that the glass transition temperature of a core binder resin and the glass transition temperature of a shell binder resin (polar resin) are each also measured in the same manner as that described above. A theoretical Tg calculated from the prescription of the core binder resin may be regarded as the glass transition temperature Tg of the core binder resin because it is difficult to isolate only the core binder resin from each particle of the toner.

<Measurement Conditions>

Equilibrium is kept at 20° C. for 5 minutes.

A modulation of 1.0° C./min is applied so that the temperature of the toner is increased to 140° C. at 1° C./min.

Equilibrium is kept at 140° C. for 5 minutes.

The temperature is reduced to 20° C.

The toner of the present invention has a core-shell structure in which adhesiveness between an inner layer (core) and an outer layer (shell) is high. The toner is preferably produced by a suspension polymerization method by using a polar resin containing the same composition as that of a binder resin of which the core is formed (core binder resin) as a resin of which the shell is formed (shell binder resin) with a view to forming such core-shell structure. With such design, phase separation between the shell binder resin and the core binder resin occurs while the shell binder resin, is compatible with the core binder resin. Accordingly, toner particles each having a core-shell structure with high adhesiveness as a result of compatibility between the respective components at an interface between the inner layer and the outer layer can be obtained.

When a vinyl-based polymer such as polystyrene, a homopolymer of a substituted styrene, or a styrene-based copolymer is used as the core binder resin, a vinyl-based polymer is preferably used as the shell binder resin as well.

As a vinyl-based copolymer that can be used as a core binder resin or a shell binder resin, for example, the following may be exemplified: a styrene-p-chlorstyrene copolymer, a styrene-vinyltoluene copolymer, a styrene-vinyl naphthaline copolymer, a styrene-acrylate copolymer, a styrene-acrylate-acrylic acid copolymer, a styrene-methacrylate-acrylic acid copolymer, a styrene-acrylate-methacrylic acid copolymer, a styrene-methacrylate-methacrylic acid copolymer, a styrene-methacrylate copolymer, a styrene-α-methyl chloromethacrylate copolymer, a styrene-acrylonitrile copolymer, a styrene-vinylmethyl ether copolymer, a styrene-vinylethyl ether copolymer, a styrene-vinylmethyl ketone copolymer, a styrene-butadiene copolymer, a styrene-isoprene copolymer, and a styrene-acrylonitrile-indene copolymer.

In addition, when a phenol resin, a maleic resin, a silicone resin, a polyester resin, a polyurethane resin, a polyamide resin, a furan resin, an epoxy resin, a polyvinylbutyral, a terpene resin, a coumarone-indene resin, or a petroleum-based resin is used as a core binder resin, a modified resin of a vinyl-based polymer and each of the above resin is exemplified as a shell binder resin.

As the shell binder resin, a shell binder resin having, in a measurement with GPC, a peak molecular weight Mp of 8,000 to 250,000, a weight average molecular weight of 8,000 to 260,000, and a rate of a number average molecular weight to a weight average molecular weight (Mw/Mn) of 1.05 to 5.00 is preferred. More preferred is a shell binder resin having a peak molecular weight Mp of 15,000 to 250,000, and a weight average molecular weight of 15,000 to 260,000. Still more preferred is a shell binder resin having a peak molecular weight Mp of 20,000 to 100,000, and a weight average molecular weight Mw of 20,000 to 110,000. In addition, a shell binder resin having a glass transition temperature of 80 to 120° C. is preferred. Further, a shell binder resin having an acid value of 5 to 40 mgKOH/g is preferred.

The content of the shell binder resin is preferably 10 to 40 parts by mass, or more preferably 15 to 30 parts by mass with respect to 100 parts by mass of a polymerizable monomer or binder resin.

When the toner particles are produced by a suspension polymerization method, in consideration of an increase in Tg of the toner due to compatibility with the polar resin (shell binder resin) to be added, the theoretical Tg of a monomer for producing the core binder resin is preferably set at a low value so that the Tg of the toner to be produced may fall within a predetermined range. Although the heat resistance (blocking resistance) of the toner is generally apt to reduce when the toner is designed with the theoretical Tg set at a low value, such design as described above in consideration of the increase can suppress a reduction in heat resistance of the toner. Then, improvements in developing performance, transferring performance, and fixing performance of the toner can be achieved, whereby the toner can obtain better characteristics than those of a conventional toner.

In the present invention, the core binder resin has a glass transition temperature of preferably 10 to 45° C., or more preferably 15 to 40° C.

In addition, the addition of an aromatic organic solvent (such as toluene or xylene) to the monomer upon production of the toner particles by a suspension polymerization method promotes phase separation between the shell binder resin and the core binder resin while achieving compatibility between the shell binder resin and the core binder resin, thereby improving the ease with which an effect of the present invention is exerted; by the way, the mechanism via which the addition promotes the phase separation is unclear.

The toner in the present invention preferably contains a polymer containing a sulfonic group, a sulfonate group, or a sulfonic acid ester group. The incorporation of such polymer uniformizes the amount in which the toner carrying member is coated with the toner in its longitudinal direction, thereby making it possible to perform development on the photosensitive member with improved faithfulness. In addition, an image having high uniformity in one page can be obtained. Further, an image transferred onto even a transfer material having low smoothness can show transfer uniformity comparable to that of an image transferred onto a transfer material having high smoothness. In addition, granulation stability in an aqueous medium can be improved when the toner particles are produced by a suspension polymerization method. A monomer having the above sulfonic group is, for example, styrene sulfonic acid, 2-acrylamide-2-methylpropane sulfonic acid, 2-methacrylamide-2-methylpropane sulfonic acid, vinyl sulfonic acid, or methacryl sulfonic acid. A compound obtained by turning a sulfonic group which any such monomer has into a salt or by esterifying the group with a methyl group or ethyl group can also be used.

The polymer containing a sulfonic group or the like to be used in the present invention may be a homopolymer of any such monomer as described above, or may be a copolymer of any such monomer as described above and any other monomer. A monomer that forms a copolymer with any such monomer as described above is a vinyl-based polymerizable monomer, and a monofunctional polymerizable monomer or a polyfunctional polymerizable monomer can be used.

Examples of the monofunctional polymerizable monomer include the following. Styrene; styrene polymerizable monomers such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethylacrylate, diethylphosphate ethylacrylate, dibutylphosphate ethylacrylate, and 2-benzoyloxy ethylacrylate; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethylmethacrylate, and dibutylphosphate ethylmethacrylate; methylene aliphatic monocarboxylate; vinyl esters such as vinyl acetate, vinyl propionate, vinyl butyrate, vinyl benzoate, and vinyl formate; vinyl ethers such as vinylmethyl ether, vinylethyl ether, and vinylisobutyl ether; and vinyl ketones such as vinylmethyl ketone, vinylhexyl ketone, and vinylisopropyl ketone.

Examples of the polyfunctional polymerizable monomer include the following. Diethyleneglycol diacrylate, triethyleneglycol diacrylate, tetraethyleneglycol diacrylate, polyethyleneglycol diacrylate, 1,6-hexanediol diacrylate, neopentylglycol diacrylate, tripropyleneglycol diacrylate, polypropyleneglycol diacrylate, 2,2'-bis(4-(acryloxy/diethoxy)phenyl)propane, trimethylolpropane triacrylate, tetramethylolmethane tetraacrylate, ethyleneglycol dimethacrylate, diethyleneglycol dimethacrylate, triethyleneglycol dimethacrylate, tetraethyleneglycol dimethacrylate, polyethyleneglycol dimethacrylate, 1,3-butyleneglycol dimethacrylate, 1,6-hexanediol dimethacrylate, neopentylglycol dimethacrylate, polypropyleneglycol dimethacrylate, 2,2'-bis(4-(methacryloxy/diethoxy)phenyl)propane, 2,2'-bis(4-(methacryloxy/polyethoxy)phenyl)propane, trimethylolpropane trimethacrylate, tetramethylolmethane tetramethacrylate, divinyl benzene, divinyl naphthaline, and divinyl ether.

The above polymer containing a sulfonic group or the like is incorporated in an amount of preferably 0.01 to 5.0 parts by mass, or more preferably 0.1 to 3.0 parts by mass with respect to 100 parts by mass of the binder resin. As long as the content of the polymer containing a sulfonic group or the like falls within the above range, good triboelectric charging performance can be imparted to the toner. In addition, granulation stability at the time of suspension polymerization can be favorably improved, whereby particles to be obtained show a sharp grain size distribution.

In the present invention, the toner particles are preferably particles produced through a granulating step in an aqueous medium.

A method of producing toner particles in an aqueous medium is, for example, any one of the following methods: an emulsion agglomeration method involving agglomerating an emulsion formed of an essential ingredient for toner particles in an aqueous medium; a suspension granulation method involving dissolving an essential ingredient for toner in an organic solvent, granulating the ingredient in an aqueous medium, and volatilizing the organic solvent after the granulation; a suspension polymerization method or emulsion polymerization method involving directly granulating a polymerizable monomer in which an essential ingredient for toner is dissolved in an aqueous medium to granulate the polymerizable monomer, and polymerizing the polymerizable monomer after the granulation; a method involving providing toner with an outer layer by utilizing seed polymerization after suspension polymerization or emulsion polymerization; and a microcapsule method typified by interfacial polycondensation or submerged drying.

Of those, a suspension polymerization method is particularly preferable because the action and effect of the present invention are easily exerted. In the suspension polymerization method, the colorant and the wax component (furthermore, a polymerization initiator, a crosslinking agent, a charge control agent, and any other additive as required) are uniformly dissolved or dispersed in polymerizable monomers so that a monomer composition is obtained. After that, the monomer composition is dispersed in a continuous layer containing a dispersion stabilizer (such as an aqueous phase) with an appropriate stirrer, and then the mixture is subjected to a polymerization reaction so that toner particles each having a desired particle diameter are obtained. After the completion of the polymerization, the toner particles are filtrated, washed, and dried by known methods, and an inorganic fine powder is mixed into each of the particles by external addition so as to adhere to the surface of each particle, whereby the toner of the present invention can be obtained.

When a toner is produced by the suspension polymerization method, the shapes of respective toner particles are substantially uniformized to a spherical shape, so a triboelectric charge quantity distribution of the particles becomes relatively uniform, and a toner having a good developing characteristic can be easily obtained. In addition, a toner which depends on an external additive to a small extent and maintains high transferring performance can be easily obtained.

Examples of the polymerizable monomer upon production of a toner by the suspension polymerization method include the monofunctional and polyfunctional polymerizable monomers described above The polyfunctional polymerizable monomer acts as a crosslinking agent, and can be used at a ratio of 0.001 to 15 parts by mass with respect to 100 parts by mass of the monofunctional polymerizable monomer. Examples of the polyfunctional polymerizable monomer include divinyl compounds such as divinyl aniline, divinyl sulfide, and divinyl sulfone, and compounds each having three or more vinyl groups in addition to the foregoing.

An oil-soluble initiator and/or a water-soluble initiator are each/is used as the polymerization initiator. A preferable polymerization initiator is such that the time period for which the molecules of the initiator reduce in half at a reaction temperature at the time of the polymerization reaction is 0.5 to 30 hours. In addition, when the polymerization reaction is performed in a state where the initiator is added in an amount of 0.5 to 20 parts by mass with respect to 100 parts by mass of the polymerizable monomer, a polymer having a local maximum in the molecular weight range of 10,000 to 40,000 is typically obtained, so a toner having an appropriate strength and an appropriate melting characteristic can be obtained.

Examples of the polymerization initiator include the following. Azo or diazo polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and the peroxide polymerization initiators such as benzoylperoxide, t-butylperoxy 2-ethylhexanoate, t-butylperoxypivalate, t-butylperoxy isobutylate, t-butylperoxyneodecanoate, methylethylketone peroxide, diisopropylperoxy carbonate, cumenehydroperoxide, 2,4-dichlorobenzoylperoxide, and lauroylperoxide. Particularly preferred is a polymerization initiator which generates the ether compounds upon decomposition during the polymerization reaction.

In the present invention, the incorporation of an ether compound represented by the following structural formula (1) or (2) into the toner can provide an image having particularly high uniformity in one page. In addition, the incorporation uniformizes the amount in which the toner carrying member is coated with the toner in its longitudinal direction, thereby making it possible to perform development with improved faithfulness. Further, an image transferred onto even a transfer material having low smoothness can show transfer uniformity comparable to that of an image transferred onto a transfer material having high smoothness. The ether compound, which may be added and incorporated as a prescription at the time of the production of the toner particles, can be produced from a product as a result of the decomposition of the polymerization initiator in a polymerization container.

[Chem 1]

(1)

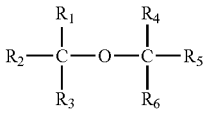

where $R_1$ to $R_6$ each represent an alkyl group having 1 to 6 carbon atoms, and may be identical to or different from one another, and

[Chem 2]

(2)

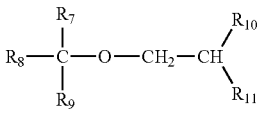

where $R_7$ to $R_{11}$ each represent an alkyl group having 1 to 6 carbon atoms, and may be identical to or different from one another.

When the above ether compound is incorporated into the toner particles, the compound may be present while being dispersed in a nearly uniform state because the compound is excellent in compatibility with the binder resin. In addition, the oxygen atom of the compound delocalizes negative charge generated in the toner because the oxygen atom is an element having a high electronegativity. The two characteristics of an ether compound can stabilize the negative charge of the toner. Accordingly, the effect of incorporating the ether compound becomes particularly significant when the toner of the present invention is a toner that can be negatively charged. In addition, the ether compound exerts a suppressing effect on charge up when the toner can be positively charged.

In addition, the ether compound is of a bulky structure because the compound has a tertiary carbon atom. The compound is hardly affected by water, and the leak of charge from the compound is suppressed because functional groups bonded to the tertiary carbon atom each function as steric hindrance. However, when the carbon atom bonded to the oxygen atom rotates, any functional group which can be steric hindrance can also move, so none of the functional groups can be complete steric hindrance to a water molecule involved in the leak of triboelectric charge from the compound. As a result, the functional groups bonded to the tertiary carbon atom each function as moderate steric hindrance to block water molecules moderately.

Therefore, a combination of the above polar resin and the above ether compound, which has conventionally contributed to a charge stabilizing effect in the entirety of the inner layer resin, can contribute to a charge stabilizing effect even in the outer layer resin. As a result, in any one of the various environments ranging from a high-temperature, high-humidity environment to a low-temperature, low-humidity environment, the entirety of the toner can be charged in an excellently balanced fashion, so excellent effects are exerted on: the uniformity with which the upper portion of the toner carrying member is coated with the toner; the maintenance of high transfer efficiency; the transfer uniformity of an image in one page; and the uniformity with which an image is transferred onto a transfer material having low smoothness. In addition, the above-mentioned moderate steric hindrance is effective in obtaining a toner having such viscoelastic characteristics as those of the present invention because the steric hindrance allows moderate control of the reactivity of each polymerizable monomer.

When any one of $R_1$ to $R_{11}$ in the ether compound represented by the above structural formula (1) or (2) represents a hydrogen atom, the extent to which a functional group the heart of which is tertiary carbon functions as steric hindrance significantly reduces. In contrast, when any one of $R_1$ to $R_{11}$ represents an alkyl group having 7 or more carbon atoms, an effect of adding the ether compound cannot be obtained owing to a remarkable change in balance between the hydrophobicity and hydrophilicity of the ether compound or a reduction in compatibility of the ether compound with the binder resin. In addition, each of $R_1$ to $R_{11}$ more preferably represents an alkyl group having 1 to 4 carbon atoms.

The above compound is incorporated at a content of preferably 5 to 1,000 ppm, more preferably 10 to 800 ppm, or still more preferably 10 to 500 ppm with reference to the mass of the toner in order that such effect as described above may be sufficiently exerted. One or more kinds of such ether compound as described above have only to be incorporated, and such ether compound as described above having another structure may be incorporated. In this case, the content is the total sum of the amounts of the incorporated ether compounds.

Examples of the structure of the ether compound include the following structures.

[Chem 3]

Ether Compound 1

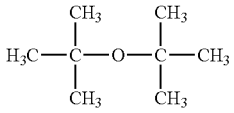

[Chem 4]

Ether Compound 2

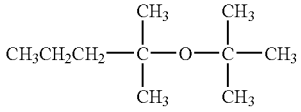

[Chem 5]

Ether Compound 3

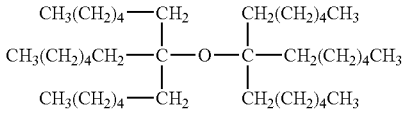

[Chem 6]

Ether Compound 4

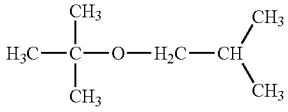

In the present invention, a known chain transfer agent or polymerization inhibitor may be used for controlling the degree of polymerization of the polymerizable monomers.

In the present invention, carbon black is utilized as a black colorant, and a colorant toned to each color by using a yellow, magenta, or cyan colorant described below is utilized. In addition, when the toner particles are produced by a suspension polymerization method, attention must be paid to polymerization-inhibiting performance or aqueous phase-migrating performance which the colorant has, so the colorant is preferably subjected to surface modification (such as a hydrophobic treatment that does not inhibit polymerization). Particular attention should be paid upon use of a dye or carbon black because the dye or carbon black often has polymerization-inhibiting performance.

Examples of the yellow colorant to be used include: compounds typified by a condensed azo compound, an isoindolinone compound, an anthraquinone compound, an azo metal complex, a methine compound, and an allylamide compound. Specific examples of the colorant to be suitably used include C. I. Pigment Yellow 12, 13, 14, 15, 17, 62, 74, 83, 93, 94, 95, 97, 109, 110, 111, 120, 128, 129, 138, 147, 150, 155, 168, 180, 185, and 214.

Examples of the magenta colorant to be used include: a condensed azo compound, a diketopyrrolopyrrole compound, anthraquinone, a quinacridone compound, a basic dye lake compound, a naphthol compound, a benzimidazolone compound, a thioindigo compound, a perylene compound. Specific examples of the colorant to be suitably used include C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 26.9, and C.I. Pigment Violet 19.

Examples of the cyan colorant to be used in the present invention include: a copper phthalocyanine compound and a derivative of the compound; an anthraquinone compound; and a basic dye lake compound. Specific examples of the colorant to be suitably used include C.I. Pigment Blue 1, 7, 15, 15:1, 15:2, 15:3, 15:4, 60, 62, and 66.

Each of those colorants can be used alone or as a mixture. Alternatively, each of the colorants can be used in the state of a solid solution. A colorant is selected in terms of a hue angle, chroma, lightness, light resistance, OHP transparency, and dispersing performance in the toner, and is added in a range of preferably 1 to 20 parts by mass with respect to 100 parts by mass of the binder resin.

The toner of the present invention may be further blended with another charge control agent in addition to the above polymer having a sulfonic group or the like at any one of its side chains in order that the charging characteristic of the toner may be stabilized. A known agent can be utilized as the charge control agent, and a charge control agent which allows the toner to be charged at a high speed and to maintain a constant triboelectric charge quantity stably is particularly preferable. Further, when the toner is produced by a direct polymerization method, a charge control agent which: has low polymerization-inhibiting performance; and is substantially free of matter soluble in an aqueous dispersion medium is particularly preferable. Specific examples of the compound to serve as a negative charge control agent include: metal compounds of aromatic carboxylic acids such as salicylic acid, alkyl salicylic acid, dialkyl salicylic acid, naphthoic acid, and dicarboxylic acid; metal salts or metal complexes of azo dyes or of azo pigments; boron compounds; silicon compounds; and calixarene. Further, specific examples of the compound to serve as a positive charge control agent include: quaternary ammonium salts; polymeric compounds having the quaternary ammonium salts at a side chains; guanidine compounds; nigrosin compounds; and imidazole compounds.

The usage of any such charge control agent is determined by the method of producing the toner including the kind of the binder resin, the presence or absence of any other additive, and a method of dispersing the additive, so the usage is not uniquely limited. However, when any such charge control agent is internally added, the charge control agent is used in an amount in the range of preferably 0.1 to 10 parts by mass, or more preferably 0.1 to 5 parts by mass with respect to 100 parts by mass of the binder resin or a polymerizable monomer. In addition, when any such charge control agent is externally added, the charge control agent is used in an amount of preferably 0.005 to 1.0 part by mass, or more preferably 0.01 to 0.3 part by mass with respect to 100 parts by mass of the toner particles.

An organic or inorganic dispersion stabilizer is preferably added to the aqueous medium to be used in suspension polymerization. For examples, as an inorganic dispersion stabilizer, there are exemplified calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silicone oxide, and aluminum oxide. As an organic dispersion stabilizer, there are exemplified polyvinyl alcohol, gelatin, methylcellulose, methylhydroxypropylcellulose, ethylcellulose, sodium salts of carboxymethylcellulose, polyacrylic acid and its salts, and starch. The dispersion stabilizer is used in an amount of preferably 0.2 to 20 parts by mass with respect to 100 parts by mass of a polymerizable monomer.

In addition, 0.001 to 0.1 part by mass of surfactant may be used to disperse those dispersion stabilizer finely. The surfactant is intended to promote the expected function of the dispersion stabilizer. Specific examples of the surfactant include sodium dodecyl benzene sulfate, sodium tetradecyl sulfate, sodium pentadecyl sulfate, sodium octyl sulfate, sodium oleate, sodium laurate, potassium stearate, and calcium oleate.

When an inorganic dispersion stabilizer is used, a commercially available dispersion stabilizer may be used as it is, or the inorganic compound may be produced in an aqueous medium in order that additionally fine particles may be obtained. Mixing an aqueous solution of sodium phosphate and an aqueous solution of calcium chloride under high-speed stirring suffices for the preparation of, for example, calcium phosphate.

The toner of the present invention is a toner including: toner particles each containing at least a binder resin, a colorant, and a wax component; and an inorganic fine powder, and the inorganic fine powder is preferably externally added.

The inorganic fine powder is added in an amount of preferably 0.01 to 5 parts by mass, or more preferably 0.1 to 4.0 parts by mass with respect to 100 parts by mass of the toner particles. As long as the addition amount falls within the above range, a sufficient improving effect on the flowability of the toner can be obtained while a reduction in fixing performance of the toner is suppressed. The inorganic fine powder has a number average primary particle diameter of preferably 4 to 80 nm, or more preferably 4 to 60 nm.

Examples of the inorganic fine powder include: metal oxides such as a titanium oxide powder, an aluminum oxide powder, and a zinc oxide powder; and silica fine powders such as a silica produced by a wet process and a silica produced by a dry process. In addition, the metal oxide or the silica fine powder may be subjected to surface treatment with a treatment agent such as a silane coupling agent, a titanium coupling agent, or silicone oil. Examples of the inorganic fine powder further include an aluminum doped silica, strontium titanate, and hydrotalcite In addition, as an external additive, fluorine-based resin powders such as a vinylidene fluoride fine powder and a polytetrafluoroethylene fine powder, and aliphatic metal salts such as a zinc stearate, calcium stearate, and a lead stearate may be added.

Next, an image-forming method using the toner of the present invention will be described.

With regard to a developing method in the image-forming method to which the toner of the present invention is applicable, a toner carrying member and the surface of a photosensitive member as an electrostatic latent image bearing member may be in, or out of, contact with each other. Here, the case where the toner carrying member and the surface of the photosensitive member contact each other will be described.

The following method can be employed: an elastic roller is used as the toner carrying member, the surface and the like of the elastic roller are coated with the toner, and the resultant is brought into contact with the surface of the photosensitive member so that development is performed. The elastic layer of which has an ASKER-C hardness of 30 to 60 degrees is suitably used as the elastic roller. When development is performed by bringing the toner carrying member and the surface of the photosensitive member into contact with each other, the development is performed by generating a developing electric field between the photosensitive member and the elastic roller opposite to the photosensitive member through the toner layer. Accordingly, the electric field must be kept while conduction between the surface of the photosensitive member and the elastic roller is prevented by controlling the resistivity of the elastic body of the elastic roller within a middle resistivity region or by providing a thin insulating layer for the surface layer of the elastic roller. Alternatively, the following constitution is also permitted: a rigid roller is used as the toner carrying member, and the photosensitive member is a flexible one such as a belt. The toner carrying member has a resistivity in the range of preferably $10^2$ to $10^9\Omega\cdot$cm from the viewpoint of the generation of a good electric field.

With regard to the surface state of the toner carrying member, the surface roughness Ra of the toner carrying member is desirably set to 0.2 to 3.0 μm because such setting can contribute to the achievement of compatibility between high quality of an image formed with the toner and high durability of the toner. The surface roughness Ra is correlated with an ability to transport the toner and an ability to charge the toner. Setting the surface roughness Ra of the toner carrying member within the above range can: suppress the ability of the surface of the toner carrying member to transport the toner to a moderate extent; and reduce the thickness of the toner layer on the toner carrying member. In addition, the number of times of contact between the toner carrying member and the toner increases, so the charging performance of the toner is improved. As a result, the quality of the image tends to improve synergistically.

In the present invention, the surface roughness Ra of the toner carrying member corresponds to a center line average roughness measured with a surface roughness measuring machine (Surfcorder SE-30H, manufactured by Kosaka Laboratory Ltd.) on the basis of the JIS surface roughness "JIS B 0601". To be specific, a portion having a measurement length a of 2.5 mm is extracted from a roughness curve in the direction of the center line of the curve. The center line of the extracted portion is indicated by an X axis, the direction of a longitudinal magnification is indicated by a Y axis, and the roughness curve is represented by y=f(x). On the foregoing condition, a value determined by the following equation in a μm unit is referred to as the surface roughness Ra.

$$Ra=1/a\int_0^a|f(x)|dx \quad \text{[Num 2]}$$

The amount in which the upper portion of the toner carrying member is coated with the toner is preferably 0.1 to 1.5 mg/cm$^2$. When the amount falls within the above range, a sufficient image density can be obtained, and the surface of the toner can be subjected to uniform triboelectric charging. The amount is more preferably 0.2 to 0.9 mg/cm$^2$.

The toner carrying member may rotate in the same direction as that of the photosensitive member at a portion opposite to the photosensitive member, or may rotate in the direction opposite to that of the photosensitive member at the portion. When both the toner carrying member and the photosensitive member rotate in the same direction, the circumferential speed of the toner carrying member is preferably set so as to be 1.05 to 3.0 times as high as that of the photosensitive member. When the circumferential speed of the toner carrying member falls within the above range, a stirring effect on the toner on the photosensitive member can be sufficiently exerted while the deterioration of the toner due to a mechanical stress and the adhesion of the toner to the toner carrying member are suppressed. As a result, the ease with which a good image is obtained is improved. A photosensitive drum or photosensitive belt having a photoconductive insulating substance layer made of, for example, a-Se, CdS, $ZnO_2$, OPC, or a-Si is suitably used as the photosensitive member.

A photosensitive layer in an OPC photosensitive member may be of a single-layer type containing a charge generation substance and a substance having charge transport performance in the same layer, or may be a separated-function photosensitive layer composed of a charge transport layer and a charge generation layer. A laminated photosensitive layer structured by laminating a charge generation layer and a charge transport layer in the stated order on a conductive substrate is one preferable example. In addition, the binder resin of an organic photosensitive layer, which is not particularly limited, is preferably a polycarbonate resin, a polyester resin, or an acrylic resin because any such resin is particularly excellent in transferring performance and reduces the frequency at which each of the melt adhesion of the toner to the photosensitive member and the filming of the external additive occurs.

Next, an image-forming apparatus to which the toner of the present invention is applicable will be described below with reference to the attached drawings.

In FIG. 1, reference symbol 100 represents a developing assembly; 109, a photosensitive member; 105, a transfer body such as paper; 106, a transfer member; 107, a pressure roller for fixation; 108, a heat roller for fixation; and 110, a primary charging member for performing direct charging by contacting the photosensitive member 109.

The primary charging member 110 uniformly charges the surface of the photosensitive member 109, and a bias power supply 115 is connected to the member.

The developing assembly 100 stores a toner 104, and includes a toner carrying member 102 that rotates in the direction indicated by an arrow while contacting the electrostatic latent image bearing member (photosensitive member) 109. Further, the assembly is provided with: a developing blade 101 as a control member for controlling the amount of the toner and for providing charge; and an applying roller 103 that rotates in the direction indicated by an arrow for causing the toner 104 to adhere to the toner carrying member 102 and for providing charge for the toner. A developing bias power supply 117 is connected to the toner carrying member 102. An unshown bias power supply is connected to the applying roller 103 as well, and, when a negatively chargeable toner is used, the voltage of the power supply is set to be smaller than the developing bias of the developing bias power supply; when a positively chargeable toner is used, the voltage is set to be larger than the developing bias.

A transfer bias power supply 116 opposite in polarity to the photosensitive member 109 is connected to the transfer member 106.

Here, a length in the rotation direction at a portion where the photosensitive member 109 and the toner carrying member 102 contact each other, that is, the so-called developing nip width is preferably 0.2 to 8.0 mm. As long as the developing nip width falls within the above range, additionally good development can be performed, and the abrasion of the photosensitive member can be suppressed.

The amount in which the toner carrying member 102 is coated with the toner is controlled by the developing blade 101, which contacts the toner carrying member 102 through a toner layer. A contact pressure in this case preferably falls within the range of 4.9 to 49 N/m (5 to 50 gf/cm). When the contact pressure falls within the above range, each of the amount in which the toner carrying member 102 is coated with the toner and the triboelectric charge quantity of the member can be easily adjusted to fall within a proper range, and the deformation of each particle of the toner and the melt adhesion of the particle to a member can be suppressed.

The free end portion of the developing blade 101 may be of an arbitrary shape as long as a preferable NE length (length from the portion of the developing blade abutting the toner carrying member to the free end) is provided. For example, an L shape bent in the vicinity of its tip or such a shape that the vicinity of the tip swells like a sphere as well as a shape having a linear sectional shape can be suitably used.

A metal blade having rigidity or the like as well as an elastic blade may be used as a member for controlling the amount in which the toner carrying member 102 is coated with the toner.

A material for the elastic control member is preferably selected from frictional charging-type materials suitable for charging a toner to desired polarity. Examples thereof which may be used include: rubber elastic bodies such as a silicone rubber, a urethane rubber, and an NBR; synthetic resin elastic bodies such as polyethylene terephthalate; and metal elastic bodies such as stainless steel, steel, and phosphor bronze. Further, composites thereof may also be used.

In addition, when durability is demanded for the elastic control member and the toner carrying member, a resin or rubber is preferably affixed to a sleeve contacting portion of a metal elastic body or the sleeve contacting portion is preferably coated.

Further, an organic or inorganic substance may be added to the elastic control member, may be melted and mixed into the member, or may be dispersed in the member. The addition of, for example, a metal oxide, a metal powder, ceramic, a carbon allotrope, a whisker, an inorganic fiber, a dye, a pigment, or a surfactant can control the charging performance of the toner. In particular, when the elastic body is a molded body of rubber, a resin, or the like, it is also preferable to incorporate, for example, a metal oxide fine powder made of silica, alumina, titania, tin oxide, zirconia, zinc oxide, or the like, carbon black, or a charge control agent to be generally used in toner into the elastic body.

Alternatively, the application of a DC voltage and/or an AC voltage to the control member can achieve a sufficient image density and provide a high-quality image because uniform thin layer-applying performance and uniform charging performance of the toner are additionally improved by virtue of a loosening action on the toner.

Each of a non-contact type corona charging device and a contact type charging member using a roller or the like can be used as the charging member; a contact type one is preferably used for efficient, uniform charging, the simplification of a charging process, and a reduction in amount in which ozone is generated.

A contact type charging member is used in FIG. 1.

The primary charging member 110 used in FIG. 1 is a charging roller basically constituted of a core mandrel 10*b* and a conductive elastic layer 110*a* forming the outer periphery of the mandrel. The charging roller 110 is brought into abutment with the entire surface of the electrostatic latent image bearing member 109 with a pressure, and rotates in association with the rotation of the electrostatic latent image bearing member.

Preferable process conditions when the charging roller is used are as follows: the pressure at which the roller abuts the electrostatic latent image bearing member is 4.9 to 490 N/m (5 to 500 gf/cm), and, when a voltage obtained by superimposing an AC voltage on a DC voltage is used as an applied voltage, the AC voltage is 0.5 to 5.0 kVpp, an AC frequency is 50 Hz to 5 kHz, and the DC voltage is ±0.2 to ±1.5 kV; when a DC voltage is used as an applied voltage, the DC voltage is ±0.2 to +5.0 kV. It should be noted that only a DC voltage is more preferably used as an applied voltage from the viewpoint of the suppression of the amount in which the drum, that is, the charging roller is shaved. Another contact charging means is a method involving the use of a charging blade or a method involving the use of a conductive brush. Such contact charging means is excellent because a required voltage and the amount in which ozone is generated can be reduced as compared to those in the case of non-contact corona charging. A conductive rubber is a preferable material for each of the charging roller and the charging blade each serving as contact charging means, and a releasable coating may be provided for the surface of the rubber. A nylon-based resin, polyvinylidene fluoride (PVDF), polyvinylidene chloride (PVDC), or the like can be applied as the releasable coating.

Contact charging means has been described as an explanation for the image-forming apparatus shown in FIG. 1; an apparatus and conditions similar to those described above can be used even when contact charging means is used in an image-forming apparatus having any other constitution.

Subsequent to the primary charging step, an electrostatic latent image in accordance with an information signal is formed on the photosensitive member 109 by exposure 123 from a light-emitting device, and the electrostatic latent image is developed with the toner at a position where the photosensitive member abuts the toner carrying member 102 so as to be turned into a visible image. Further, a combination of the image-forming method of the present invention with, in particular, a developing system in which a digital latent image is formed on a photosensitive member allows a latent image to be developed faithfully to a dot latent image because the latent image is not disturbed. The visible image is transferred onto the transfer body 105 by the transfer member 106, and passes through a gap between the heat roller 108 and the pressure roller 107 so as to be fixed, whereby a fixed image is obtained. It should be noted that a system in which the image is fixed under heat with a heater through a film as well as a thermal roller system basically constituted of a heat roller in which a heating element such as a halogen heater is built and a pressure roller made of an elastic body brought into press contact with the heat roller with a pressure is used as heat pressure fixing means.

On the other hand, the transfer residual toner remaining on the photosensitive member 109 without being transferred is recovered by a cleaner 138 having a cleaning blade abutting the surface of the photosensitive member 109, whereby the photosensitive member 109 is cleaned.

Further, an image-forming method and an apparatus unit each using the toner of the present invention will be described with reference to the drawings.

Figure 2:
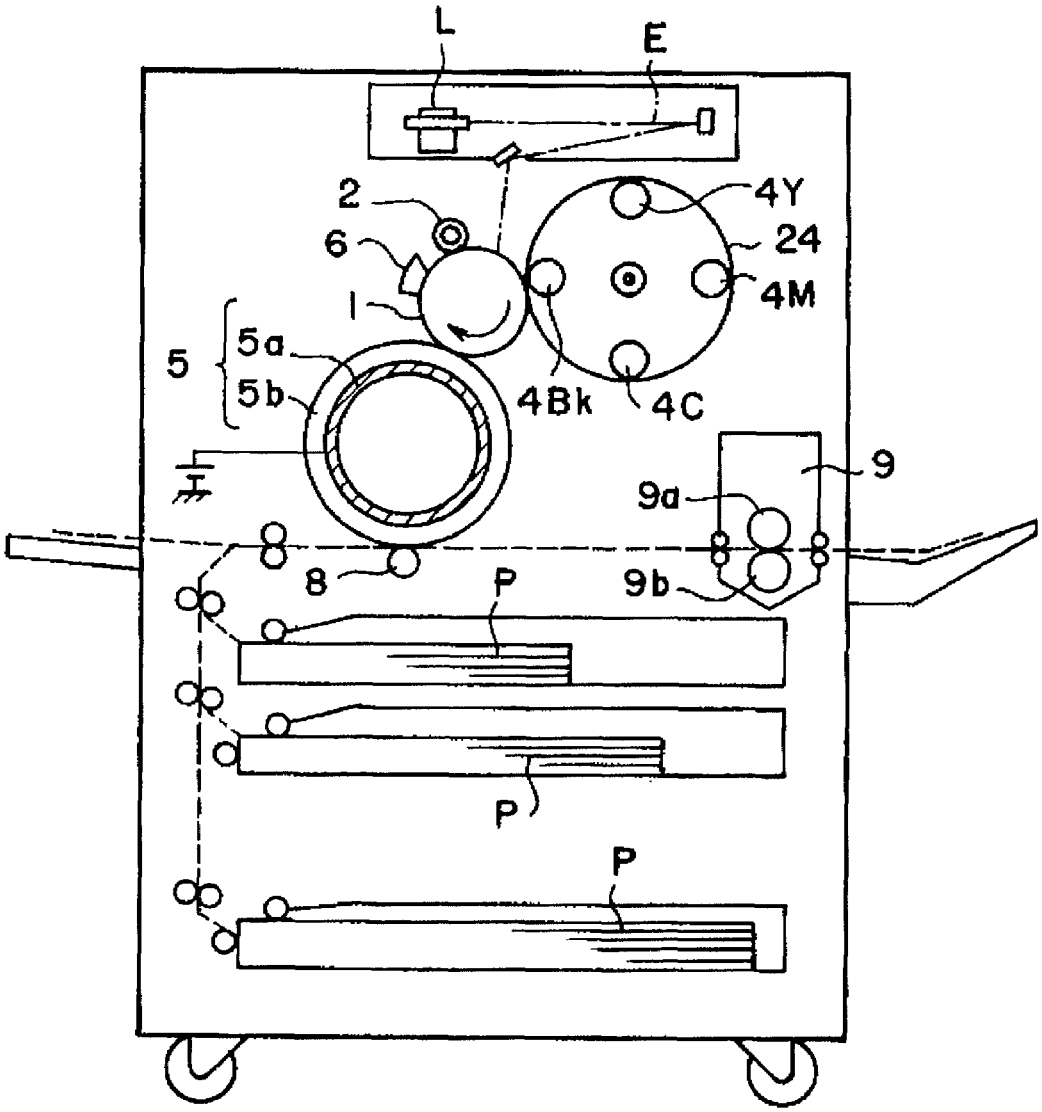
FIG. 2 is an outline view showing an example of an image-forming apparatus using an intermediate transfer drum.
Figure 3:
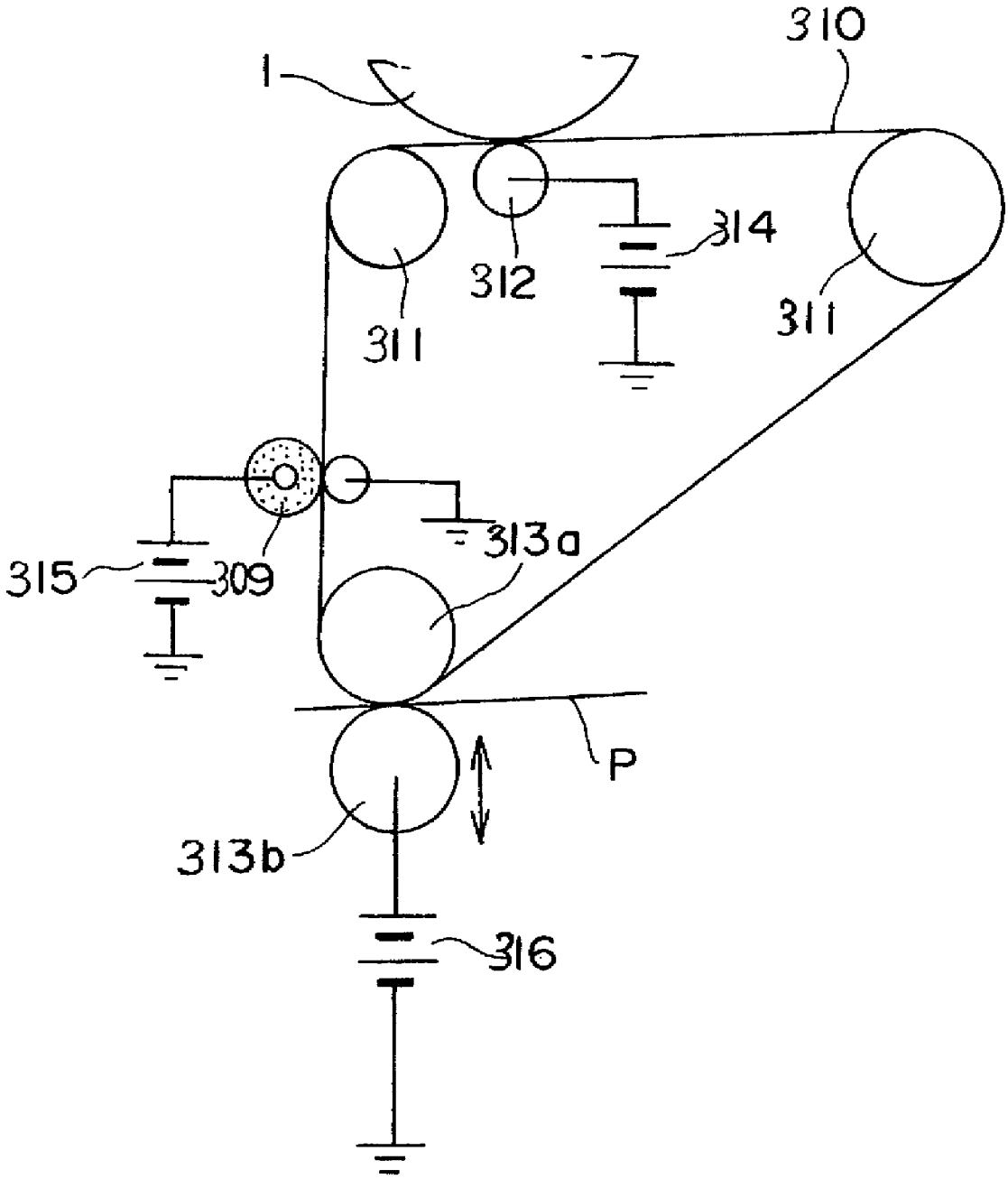
FIG. 3 is an explanatory view showing an example of the constitution of an intermediate transfer belt.

FIGS. 2 and 3 each show an outline view of an image-forming apparatus that transfers multiple toner images collectively onto a recording material by using an intermediate transfer body on the basis of the image-forming method of the present invention.

A charging roller 2 to which a charging bias voltage has been applied is brought into contact with the surface of an electrostatic latent image bearing member (photosensitive drum) 1 as a latent image bearing member while the roller is rotated, whereby the surface of the photosensitive drum is subjected to primary charging. After that, a first electrostatic latent image is formed on the photosensitive drum 1 by laser light E emitted from a light source apparatus L as exposing means. The formed first electrostatic latent image is developed with a black toner in a black developing assembly 4Bk as a first developing assembly provided for a rotatable rotary unit 24, whereby a black toner image is formed. The black toner image formed on the photosensitive drum 1 is subjected to electrostatic primary transfer onto an intermediate transfer drum 5 by the action of a transfer bias voltage applied to the conductive support of the intermediate transfer drum. Next, as in the case of the foregoing, a second electrostatic latent image is formed on the surface of the photosensitive drum 1, and is developed with a yellow toner in a yellow developing assembly 4Y as a second developing assembly by rotating the rotary unit 24 so that a yellow toner image is formed, and the yellow toner image is subjected to electrostatic primary transfer onto the intermediate transfer drum 5 onto which the black toner image has been subjected to primary transfer. Similarly, a third electrostatic latent image is formed, and is developed with a magenta toner in a magenta developing assembly 4M as a third developing assembly by rotating the rotary unit 24. Further, a fourth electrostatic latent image is formed, and is developed with a cyan toner in a cyan developing assembly 4C as a fourth developing assembly by rotating the rotary unit 24, and the resultant images are sequentially subjected to primary transfer. Thus, the respective color toner images are subjected to primary transfer onto the intermediate transfer drum 5. The multiple toner images subjected to primary transfer onto the intermediate transfer drum 5 are collectively subjected to electrostatic secondary transfer onto a recording material P by the action of a transfer bias voltage from a second transfer apparatus 8 placed so as to be opposite to the drum through the recording material P. The multiple toner images that have been subjected to secondary transfer onto the recording material Pare fixed to the recording material P under heat by a fixing apparatus 9 having a heat roller 9*a* and a pressure roller 9*b*. The transfer residual toner remaining on the surface of the photosensitive drum 1 after the transfer is recovered by a cleaner 6 having a cleaning blade abutting the surface of the photosensitive drum 1, whereby the photosensitive drum 1 is cleaned.

The primary transfer from the photosensitive drum 1 onto the intermediate transfer drum 5 is as follows: the toner images are transferred by applying a transfer bias from an unshown power supply to the conductive support of the intermediate transfer drum 5 as a first transfer apparatus.

The intermediate transfer drum 5 is composed of a conductive support 5*a* made of a rigid body and an elastic layer 5*b* for covering the surface of the support.

For example, metals and alloys such as aluminum, iron, copper, and stainless steel, and conductive resins in each of which carbon, a metal particle, or the like is dispersed can each be used in the conductive support 5*a*. The shape of the support is, for example, a cylindrical shape, a cylinder having an axis penetrating through the center of the cylinder, or a cylinder the inside of which is reinforced.

As the elastic layer 5*b*, one formed of the following materials is exemplified: elastomer rubbers such as a styrene-butadiene rubber, a high styrene rubber, a butadiene rubber, an isoprene rubber, an ethylene-propylene copolymer, a terpolymer of ethylene propylene diene (EPDM), a nitrile butadiene rubber (NBR), a chloroprene rubber, a butyl rubber, a silicone rubber, a fluorine rubber, a nitrile rubber, a urethane rubber, an acrylic rubber, an epichlorohydrin rubber, and a norbornene rubber; and resins such as a polyolefin-based resin, a silicone resin, a fluorine-based resin, and polycarbonate, copolymers thereof, and mixtures thereof.

In addition, a surface layer in which a lubricant having high lubricating property and high repellency is dispersed in the binder may be provided on the elastic layer.

Examples of the lubricant include the following: fluorine compounds such as various fluororubbers, fluorine elastomers, fluorocarbons each binding to black lead or graphite, polytetrafluoroethylene, polyvinylidene fluoride, an ethylene-tetrafluoroethylene copolymer, and a tetrafluoroethylene perfluoroalkyl vinylether copolymer; silicone-based compounds such as a silicone resin, a silicone rubber, and a silicone elastomer; polyethylene; polypropylene; polystyrene; an acrylic resin; a polyamide resin; a phenol resin; and an epoxy resin.

Alternatively, a conductive agent may be added to the binder of the surface layer for controlling the resistivity of the surface layer at the correct time. Examples of the conductive agent include: various conductive inorganic particles; carbon black; ionic conductive agents; conductive resins; and conductive particle-dispersed resins.

The multiple toner images formed on the intermediate transfer drum 5 are collectively subjected to secondary transfer onto the recording material P by the second transfer member 8; non-contact electrostatic transferring means such as a corona charging device, or contact electrostatic transferring means such as a transfer roller or a transfer belt can be used as transferring means.

When a transfer roller is used, a voltage applied to the transfer roller can be reduced by setting the volume resistivity of the elastic layer of the transfer roller to be lower than that of the elastic layer of the intermediate transfer drum, so a good toner image can be formed on a transfer material. At the same time, the winding of the transfer material around the intermediate transfer body can be prevented. The volume resistivity of the elastic layer of the intermediate transfer body is particularly preferably ten or more times as high as that of the elastic layer of the transfer roller.

The hardness of each of the intermediate transfer drum and the transfer roller is measured in conformance with JIS K-6301. The intermediate transfer drum to be used in the present invention is preferably constituted of an elastic layer the hardness of which falls within the range of 10 to 40 degrees. Meanwhile, the hardness of the elastic layer of the transfer roller, which is higher than that of the elastic layer of the intermediate transfer drum, is preferably 41 to 80 degrees in order that the winding of the transfer material around the intermediate transfer drum may be prevented. When the hardness of the intermediate transfer drum is higher than that of the transfer roller, depressed portions are formed on the side of the transfer roller, so the winding of the transfer material around the intermediate transfer drum is apt to occur.

Instead of the thermal roller fixing apparatus having the heat roller 9*a* and the pressure roller 9*b*, a film heat fixing apparatus capable of conducting the following action can also be used as the fixing apparatus 9: the apparatus heats a film contacting the toner images on the recording material P to heat the toner images on the recording material P so that the multiple toner images are fixed to the recording material P under heat.

The multiple toner images can be collectively transferred onto the recording material by using an intermediate transfer belt instead of the intermediate transfer drum as an intermediate transfer body used by the image-forming apparatus shown in FIG. 2. FIG. 3 shows the constitution of the intermediate transfer belt.

Toner images formed on and carried by the electrostatic latent image bearing member (photosensitive drum) 1 are sequentially subjected to primary transfer onto the outer peripheral surface of an intermediate transfer belt 310 by an electric field generated by a primary transfer bias applied from a primary transfer roller 312 to the intermediate transfer belt 310 when the images pass through a nip portion between the photosensitive drum 1 and the intermediate transfer belt 310. Reference symbol 311 represents a roller around which the intermediate transfer belt 310 is looped.

The primary transfer bias for sequentially transferring first to fourth color toner images in a superimposed fashion from the photosensitive drum 1 onto the intermediate transfer belt 310 is opposite in polarity to the toner on the drum, and is applied from a bias power supply 314.

In the step of subjecting the first to third color toner images to primary transfer from the photosensitive drum 1 onto the intermediate transfer belt 310, a secondary transfer roller 313*b* and a charging member 309 for cleaning can be made apart from the intermediate transfer belt 310.

The secondary transfer roller 313*b* is borne so as to be parallel to a secondary transfer opposite roller 313*a*, and is provided at the lower surface portion of the intermediate transfer belt 310 so that the roller can be made apart from the belt.

The multiple color toner images transferred onto the intermediate transfer belt 310 are transferred onto the transfer material P as described below. While the secondary transfer roller 313*b* is brought into abutment with the intermediate transfer belt 310, the transfer material P is fed into an abutting nip between the intermediate transfer belt 310 and the secondary transfer roller 313*b* at a predetermined timing, and a secondary transfer bias is applied from a bias power supply 316 to the secondary transfer roller 313*b*. The multiple color toner images are subjected to secondary transfer from the intermediate transfer belt 310 onto the transfer material P by the secondary transfer bias.

After the completion of the transfer of the images onto the transfer material P, the charging member 309 for cleaning is brought into abutment with the intermediate transfer belt 310, and a bias opposite in polarity to the photosensitive drum 1 is applied from a bias power supply 315, whereby the toner (transfer residual toner) remaining on the intermediate transfer belt 310 without being transferred onto the transfer material P is provided with charge opposite in polarity to the photosensitive drum 1.

The transfer residual toner is electrostatically transferred onto the photosensitive drum 1 at the nip portion between the photosensitive drum 1 and the intermediate transfer belt 310 and in the vicinity of the nip portion, whereby the intermediate transfer body is cleaned.

The intermediate transfer belt is composed of a belt-shaped base layer and a surface-treated layer provided on the base layer. It should be noted that the surface-treated layer may be composed of multiple layers. Rubber, an elastomer, or a resin can be used in each of the base layer and the surface-treated layer.

As the rubber and elastomer, the following may be exemplified: natural rubbers; an isoprene rubber; a styrene-butadiene rubber, a butadiene rubber; a butyl rubber; an ethylene-propylene rubber; an ethylene-propylene terpolymer; a chloroprene rubber; a chlorosulfonated polyethylene; a chlorinated polyethylene; an acrylonitrile butadiene rubber; a urethane rubber; a syndiotactic 1,2-polyburadiene; an epichlorohydrin rubber; an acrylic rubber; a silicone rubber; a fluororubber; polysulfide rubbers; a polynorbornene rubber; a hydrogenated nitrile rubber; and thermoplastic elastomers (such as a polyethylene-based, polyolefin-based, polyvinyl chloride-based, polyurethane-based, polyamide-based, polyester-based, and fluororesin-based elastomer). One kind of rubber or elastomer selected from the group or two or more kinds of rubbers or elastomers selected from the group may be used.

In addition, as the resin, a polyolefine-based resin, a silicone resin, a fluororesin, or a polycarbonate may be used. The copolymer or mixture of those resins may be used.

As the base layer, a layer in which the above rubber, elastomer, or resin is covered with, dipped into, or sprayed to one side or both sides of a woven fabric-like, non-woven fabric-like, filamentous, or film-like core body layer may be used.

As the material forming the core body layer, the following may be exemplified: natural fibers such as cotton, silk, hemp, and wool; regenerated fibers such as a chitin fiber and an alginic acid fiber, and regenerated celluolose fiber; half-synthetic fibers such as an acetate fiber; synthetic fibers such as a polyester fiber, a nylon fiber, an acrylic fiber, a polyolefin fiber, a polyvinyl alcohol fiber, a polyvinyl chloride fiber, a polyvinylidene chloride fiber; a polyurethane fiber, a polyalkyl paraoxybenzoate fiber, a polyacetal fiber, an aramide fiber, a polyfluoroethylene fiber, and a phenol fiber; inorganic fibers such as a carbon fiber, a glass fiber, and a boron fiber; metal fibers such as a iron fiber and a copper fiber. One kind of fiber selected from the group or two or more kinds of fibers selected from the group may be used.

Further, a conductive additive may be added to the inside of each of the base layer and the surface-treated layer for controlling the resistivity of the intermediate transfer belt. Examples of the conductive agent include: carbon; metal powders each made of, for example, aluminum or nickel; metal oxides such as titanium oxide; quaternary ammonium salt-containing polymethyl methacrylate; and conductive polymer compounds such as polyvinyl aniline, polyvinyl pyrrole, polydiacetylene, polyethyleneimine, a boron-containing polymer compound, and polypyrrole. One or two or more kinds selected from the group of those agents can be used.

In addition, a lubricant may be added as required for enhancing the lubricity of the surface of the intermediate transfer belt so that the efficiency with which an image on the belt is transferred onto the transfer material P may be improved. A lubricant similar to that used in the elastic layer of the intermediate transfer drum can be used as the lubricant.

Next, an image-forming method involving forming respective color toner images in multiple image-forming portions and sequentially transferring the images in a superimposed fashion onto the same transfer material will be described with reference to FIG. 4.

Figure 4:
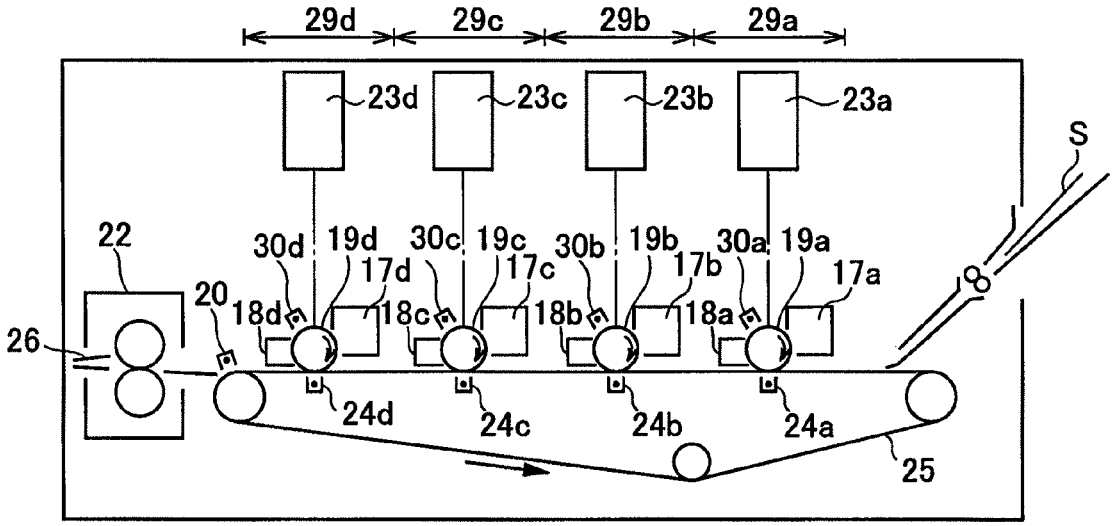
FIG. 4 is an outline view showing an example of an image-forming method involving forming respective color toner images in multiple image-forming assembly and sequentially transferring the images in a superimposed fashion onto the same transfer material

In the image-forming apparatus shown in FIG. 4, a first image-forming portion 29*a*, a second image-forming portion 29*b*, a third image-forming portion 29*c*, and a fourth image-forming portion 29*d* are provided in tandem, and each of the image-forming portions is provided with a dedicated electrostatic latent image bearing member, that is, the so-called photosensitive drum 19*a*, 19*b*, 19*c*, or 19*d*.

Charging means 30*a*, 30*b*, 30*c*, or 30*d*, latent image-forming means 23*a*, 23*b*, 23*c*, or 23*d*, developing means 17*a*, 17*b*, 17*c*, or 17*d*, transferring means (discharging means for transfer) 24*a*, 24*b*, 24*c*, or 24*d*, and cleaning means 18*a*, 18*b*, 18*c*, or 18*d* are placed on the outer peripheral side of each of the photosensitive drums 19*a* to 19*d*.

In such constitution, first, the photosensitive drum 19*a* of the first image-forming portion 29*a* is charged by the charging means 30*a*, and then, for example, a latent image-corresponding to a yellow component color in an original image is formed by the latent image-forming means 23*a*. The latent image is turned into a visible image with the developer having a yellow toner of the developing means 17*a*, and is transferred onto a recording material S as a transfer material by the transferring means 24*a*.

While the yellow image is transferred onto the transfer material S as described above, a latent image corresponding to a magenta component color is formed on the photosensitive drum 19*b* in the second image-forming portion 29*b*. Subsequently, the latent image is turned into a visible image with the developer having a magenta toner of the developing means 17*b*. When the transfer material S where the above transfer in the first image-forming portion 29*a* has been completed is transported to the transferring means 24*b*, the visible image (magenta toner image) is transferred onto a predetermined position of the transfer material S so as to be superimposed on the yellow image.

Hereinafter, cyan and black color images are formed by the third image-forming portion 29*c* and the fourth image-forming portion 29*d*, respectively in the same manner as that described above, and the cyan and black color images are transferred onto the above same transfer material S so as to be superimposed on the yellow and magenta images. After the completion of such image-forming processes, the transfer material S is transported by a transport belt 25 to fixing means 22 so that the images on the transfer material S are fixed. Thus, multiple color images can be obtained on the transfer material S. After the completion of the transfer, the residual toner on each of the photosensitive drums 19*a*, 19*b*, 19*c*, and 19*d* is removed by the cleaning means 18*a*, 18*b*, 18*c*, or 18*d*. Subsequently, a series of the image-forming processes is repeated.

In the image-forming apparatus, a transport belt using a mesh made of Tetron (registered trademark) fibers, or a transport belt using a thin dielectric sheet such as a polyethylene terephthalate-based resin, a polyimide-based resin, or a urethane-based resin is preferably utilized as transport means for transporting the transfer material from the viewpoints of easy processing and durability.

Since such transport belt generally has a high volume resistivity and the charge quantity of the transport belt increases in the course of the repetition of several times of transfer in the formation of a color image, a transfer current must be increased sequentially every time transfer is performed in order that transferred images may maintain uniform quality. However, the toner of the present invention is excellent in transferring performance, so, even when the charge quantity of the transport means increases every time transfer is performed, transferred images can show highly uniform quality while the respective transferring steps are performed with the same transfer current. Accordingly, images each having a good appearance can be obtained.

Once the transfer material S passes through the fourth image-forming portion 29*d*, an AC voltage is applied to an eliminator 20. As a result, the transfer material S is subjected to an antistatic treatment, and is separated from the belt 25. After that, the material enters the fixing unit 22 so that the images are fixed. Then, the material is discharged from a discharge port 26.

Figure 5:
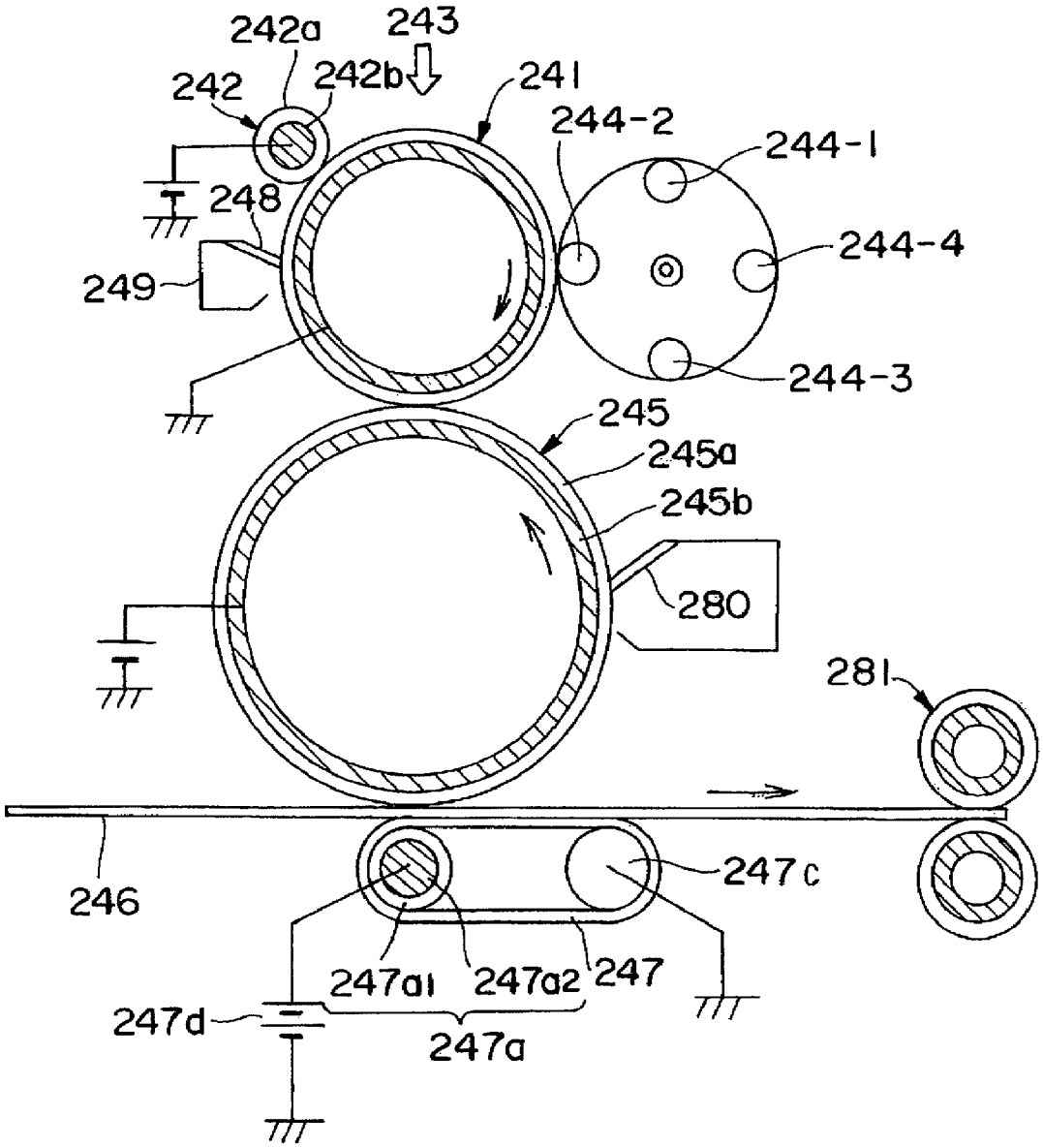
FIG. 5 is an outline view showing an example of an image-forming apparatus which: forms respective color toner images in multiple image-forming assembly; and sequentially transfers the images in a superimposed fashion onto the same transfer material.

FIG. 5 is an explanatory view of an image-forming apparatus which: uses an intermediate transfer drum; and uses a transfer belt as secondary transfer means upon collective secondary transfer of four color toner images subjected to primary transfer onto the intermediate transfer drum onto a recording material.

In the apparatus system shown in FIG. 5, a developer having a cyan toner is introduced into a developing assembly 244-1, a developer having a magenta toner is introduced into a developing assembly 244-2, a developer having a yellow toner is introduced into a developing assembly 244-3, and a developer having a black toner is introduced into a developing assembly 244-4. A photosensitive member 241 is charged by charging means, and is then subjected to exposure 243 so that electrostatic images are formed. The electrostatic images are developed with the developing assemblies 244-1 to 244-4 so that respective color toner images are sequentially formed on the electrostatic latent image bearing member (photosensitive member) 241. In addition, the photosensitive member 241 is rotated by an unshown driver apparatus in the direction indicated by an arrow.

In the charging step, a charging roller 242 basically constituted of a core mandrel 242*b* and a conductive elastic layer 242*a* forming the outer periphery of the mandrel is used. The charging roller 242 is brought into press contact with the surface of the photosensitive member 241 with a pressure, and rotates in association with the rotation of the photosensitive member 241.

The toner images on the photosensitive member are transferred onto an intermediate transfer drum 245 to which a voltage (of, for example, ±0.1 to ±5 kV) has been applied. The surface of the photosensitive member after the transfer is cleaned by cleaning means 249 having a cleaning blade 248.

An intermediate transfer drum similar to that described above can be used as the intermediate transfer drum 245. It should be noted that reference symbol 245*b* represents a conductive support made of a rigid body, and reference symbol 245*a* represents an elastic layer covering the surface of the support.

The intermediate transfer drum 245 is borne so as to be parallel to the photosensitive member 241, and is provided at the lower surface portion of the photosensitive member 241 so as to contact the lower surface portion. The drum rotates in the counterclockwise direction indicated by an arrow at the same circumferential speed as that of the photosensitive member 241.

When the first toner image formed on and carried by the surface of the photosensitive member 241 passes through a transferring nip portion where the photosensitive member 241 and the intermediate transfer drum 245 contact each other, the image is subjected to intermediate transfer onto the outer surface of the intermediate transfer drum 245 by an electric field generated at the transferring nip region by a transfer bias applied to the intermediate transfer drum 245.

After the toner images have been transferred onto a transfer material, the surface of the intermediate transfer drum 245 is cleaned by detachable cleaning means 280 as required. When a toner image is present on the intermediate transfer drum, the cleaning means 280 is made apart from the surface of the intermediate transfer body so as not to disturb the toner image.

In FIG. 5, a transfer belt 247 is placed below the intermediate transfer drum 245. The transfer belt 247 is looped around two rollers placed so as to be parallel to the axis of the intermediate transfer drum 245, that is, a bias roller 247*a* and a tension roller 247*c*, and is driven by driver means (not shown). The transfer belt 247 is constituted so that part of the belt on the side of the bias roller 247*a* can move in the direction indicated by an arrow about part of the belt on the side of the tension roller 247*c*. As a result, the belt can be brought into contact with, or made apart from, the intermediate transfer drum 245 from below the drum in the direction indicated by the arrow. A desired secondary transfer bias is applied to the bias roller 247*a* by a secondary transfer bias source 247*d* while the tension roller 247*c* is grounded.

Next, the transfer belt 247 will be described. In this embodiment, a rubber belt obtained by superimposing a fluororubber layer (having a thickness of 20 μm and a volume resistivity of $10^{15}\Omega\cdot$cm (at the time of the application of 1 kV)) on a carbon-dispersed thermosetting urethane elastomer layer (having a thickness of about 300 μm and a volume resistivity of $10^{8}$ to $10^{12}\Omega\cdot$cm (at the time of the application of 1 kV)) was used. The belt is of a tubular shape having the following outside dimensions: a perimeter of 80 mm and a width of 300 mm.

The above-mentioned transfer belt 247 may be tensioned by the bias roller 247*a* and the tension roller 247*c* described above so as to extend by about 5%.

The transfer belt 247 is rotated at a circumferential speed identical to or different from that of the intermediate transfer belt 245. A transfer material 246 is transported into a gap between the intermediate transfer belt 245 and the transfer belt 247, and, at the same time, a bias opposite in polarity to the triboelectric charge which each toner on the intermediate transfer drum 245 has is applied from the secondary transfer bias source 247*d* to the transfer belt 247, whereby the toner images on the intermediate transfer drum 245 are transferred onto the surface side of the transfer material 246.

A material similar to that used in the charging roller can also be used as a material for the bias roller, and preferable process conditions upon transfer are as follows: the pressure at which the roller abuts the intermediate transfer drum 245 is 4.9 to 490 N/m (5 to 500 gf/cm), and a DC voltage is ±0.2 to ±10 kV.

For example, a conductive elastic layer 247*a*1 of the bias roller 247*a* is made of an elastic body having a volume resistivity of about $10^{6}$ to $10^{10}\Omega\cdot$cm such as polyurethane or an ethylene-propylene-diene-based terpolymer (EPDM) in which a conductive material such as carbon is dispersed. A bias is applied to a mandrel 247*a*2 by a constant-voltage power supply. The bias condition is preferably ±0.2 to ±10 kV.

Next, the transfer material 246 is transported to a fixing unit 281 basically constituted of a heat roller in which a heating element such as a halogen heater is built and a pressure roller made of an elastic body brought into press contact with the heat roller with a pressure. The transfer material passes through a gap between the heat roller and the pressure roller so that the toner images are fixed to the transfer material under heat and pressure. Alternatively, the images may be fixed with a heater through a film.

EXAMPLES

Hereinafter, the present invention will be described by way of examples. However, the present invention is not limited by the examples. It should be noted that the term "part(s)" used in each example means "part(s) by mass" without exception.

Example 1

Preparation of Aqueous Dispersion Medium

| | |
|---|---|
| Water | 350 parts |
| Tricalcium phosphate | 3 parts |

The temperature of the mixture of the above components was held at 60° C. while the mixture was stirred with a high-speed stirring apparatus TK-homomixer at a speed of 12,000 rpm, whereby an aqueous dispersion medium was prepared.

(Preparation of Polymerizable Monomer Composition 1)

| | |
|---|---|
| Styrene | 65 parts |
| C.I. Pigment Blue 15:3 | 5 parts |
| Negative charge control agent (aluminum 3,5-di-t-butyl salicylate compound) | 1 part |

The above prescriptions were dispersed with an Attritor at normal temperature for 5 hours, whereby a monomer mixture 1 was prepared.

Subsequently, the monomer mixture 1 was loaded into a stirring tank the temperature of which could be controlled, and its temperature was increased to 60° C.

Next, 10 parts of a Fischer-Tropsch wax (having the highest endothermic peak at 75° C.) were loaded into the above stirring tank, and the resultant mixture was continuously stirred for an additional 1 hour, whereby a polymerizable monomer composition 1 was prepared.

(Preparation of Polymerizable Monomer Composition 2)

| | |
|---|---|
| n-butyl acrylate | 35 parts |
| FCA1001NS (vinyl-based polymer having a sulfonic group; manufactured by FUJIKURA KASEI CO., LTD.) | 1 part |
| Polar resin (styrene-methacrylic acid-methyl methacrylate copolymer (copolymerization ratio (mass ratio) = 96:1.5:2.5, Mp = 58,000, Mw = 57,000, Tg = 102° C., acid value = 20 mgKOH/g, Mw/Mn = 2.1)) | 25 parts |
| Di-t-butyl ether (Ether Compound 1) | 0.05 part |

The above prescriptions were loaded into a stirring tank the temperature of which could be controlled, and the temperature of the mixture was increased to 60° C. The mixture was stirred until the polymerization conversion ratio of n-butyl acrylate reached 5%, whereby a polymerizable monomer composition 2 was prepared. It should be noted that the above polymerization conversion ratio is measured as described below. The monomer mixture is diluted with acetone, and the diluted solution is filtrated. The filtrate is subjected to gas chromatography so that the peak area of a peak inherent in n-butyl acrylate is measured. The conversion ratio can be determined from a ratio between the peak area of n-butyl acrylate at the time of the measurement and a peak area when n-butyl acrylate does not undergo any reaction at all.

(Granulation/Polymerizing Step)

The polymerizable monomer composition 1 was loaded into the above aqueous dispersion medium. Next, the polymerizable monomer composition 2 was loaded into the mixture. Further, 8.0 parts of 2,2'-azobis-isobutyrovaleronitrile as a polymerization initiator were added to the resultant mixture, and the whole was granulated for 30 minutes while the number of revolutions of the stirring apparatus was kept at 12,000 rpm. After that, the high-speed stirring apparatus was changed to a propeller type stirring apparatus. The temperature inside the apparatus was increased to 70° C., and the granulated product was subjected to a reaction for 5 hours while being slowly stirred with the apparatus. Next, the temperature inside a container containing the resultant was increased to 80° C., and was kept at the temperature for 5 hours. After that, the container was cooled.

(Washing/Solid-Liquid Separation/Drying Step/External Addition Step)

Dilute hydrochloric acid was added to the resultant polymer fine particle-dispersed liquid to adjust the pH of the liquid to 1.4. Then, a dispersion stabilizer $Ca_3(PO_4)_2$ was dissolved in the mixture. Further, the resultant particles were separated by filtration and washed. After that, the particles were dried in a vacuum at a temperature of 40° C., and their particle diameters were adjusted by classification with a screen, whereby non-magnetic cyan toner particles were obtained. 2.0 parts of hydrophobic silica having a specific surface area according to a BET method of 200 $m^2/g$ (obtained by treating 100 parts of parent silica with 10 parts of silicone oil and having a number average primary particle diameter of 13 nm) were externally added to 100 parts of the resultant toner particles by stirring with a Henschel mixer for 10 minutes, whereby Cyan Toner No. 1 was obtained. Table 1 shows the physical properties of Cyan Toner No. 1. In addition, the toner was evaluated for the items to be described later. Table 2 shows the results of the evaluation.

An image was formed of Cyan Toner No. 1 with a reconstructed apparatus of a laser beam printer (LBP-840 manufactured by Canon Inc.), and was evaluated.

Figure 6:
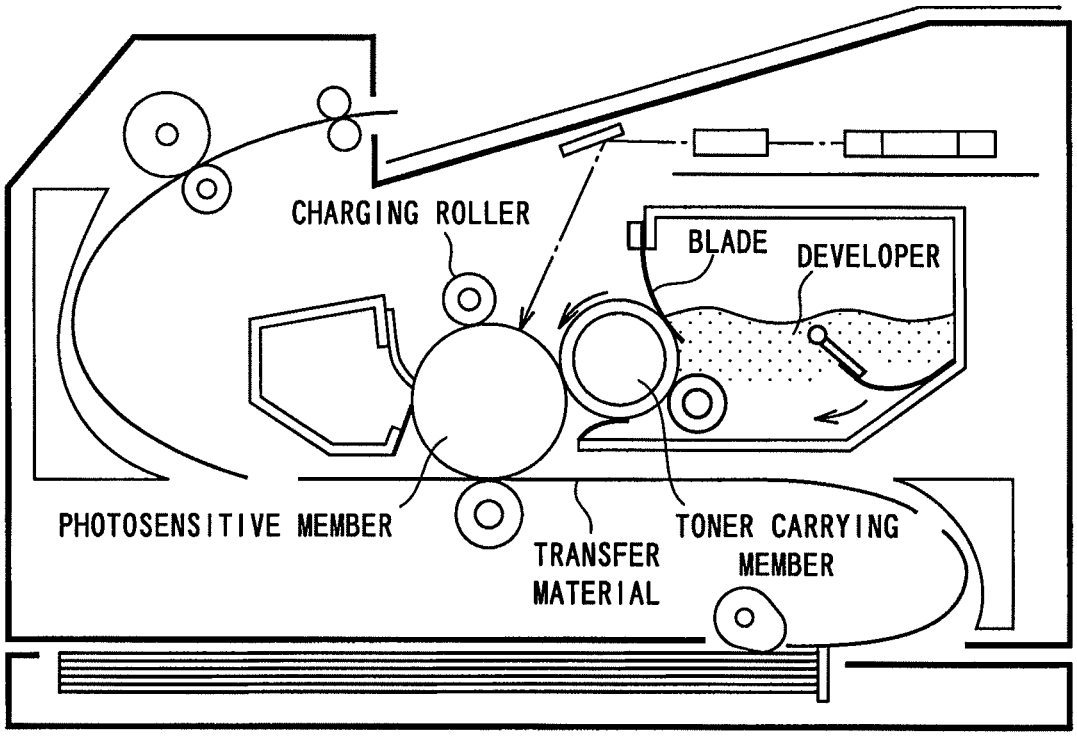
FIG. 6 is an outline view showing an example of an image-forming apparatus used in examples.

FIG. 6 is an outline view of the reconstructed apparatus of the laser beam printer (LBP-840 manufactured by Canon Inc.) utilizing an electrophotographic process based on a non-magnetic, one-component contact developing system. In this example, the following parts (a) to (g) were reconstructed.

(a) The charging system of the apparatus was changed to contact charging in which a rubber roller was brought into abutment with a photosensitive member, and a DC voltage (−1,200 V) was applied to the photosensitive member.

(b) A toner carrying member was changed to a middle resistivity rubber roller composed of a silicone rubber in which carbon black was dispersed (having a diameter of 16 mm, an ASKER-C hardness of 45 degrees, and a resistivity of $10^5 \Omega \cdot cm$), and the roller was brought into abutment with the photosensitive member.

(c) The toner carrying member was driven so as to rotate in the same direction as that of the photosensitive member at its portion contacting the photosensitive member at a circumferential speed corresponding to 150% of that of the photosensitive member.

(d) The photosensitive member was changed to the following one.

An Al cylinder was used as a substrate, and layers constituted as described below were sequentially laminated on the substrate by dip coating, whereby the photosensitive member was produced.

Conductive coat layer: a phenol resin containing tin oxide and titanium oxide and having a thickness of 15 μm Undercoat layer: a layer composed of denatured nylon and copolymerized nylon and having a thickness of 0.6 μm Charge generation layer: a titanyl phthalocyanine pigment-containing butyral resin having an absorption band in a long wavelength region and having a thickness of 0.6 μm Charge transport layer: a triphenylamine compound-containing polycarbonate resin (with a molecular weight according to Ostwald's viscosity theory of 20,000) having a thickness of 20 μm (e) An applying roller composed of a foamed urethane rubber was provided as means for applying a toner to the toner carrying member in a developing assembly of the apparatus, and was brought into abutment with the toner carrying member. A voltage composed of a DC component (−600 V) was applied to the applying roller.

(f) A resin-coated stainless blade was used as a control member for controlling a toner coat layer on the toner carrying member.

(g) An applied voltage at the time of development was composed only of a DC component (−450 V).

An extremely thin layer of a commercially available coating was applied to the surface of a rubber roller having the same diameter, the same hardness, and the same resistivity as those of the toner carrying member to be used in the image-forming apparatus, and the image-forming apparatus was temporarily assembled. After that, the rubber roller was removed, and the surface of the stainless blade was observed with an optical microscope so that an NE length was measured. The NE length was 1.05 mm.

As described below, an electrophotographic apparatus was reconstructed, and its process condition was set so that the apparatus might conform to the above reconstruction of a process cartridge.

The dark portion of the photosensitive member was charged at a potential of −600 V, and the light portion of the photosensitive member was charged at a potential of −150 V.

Figure 7:
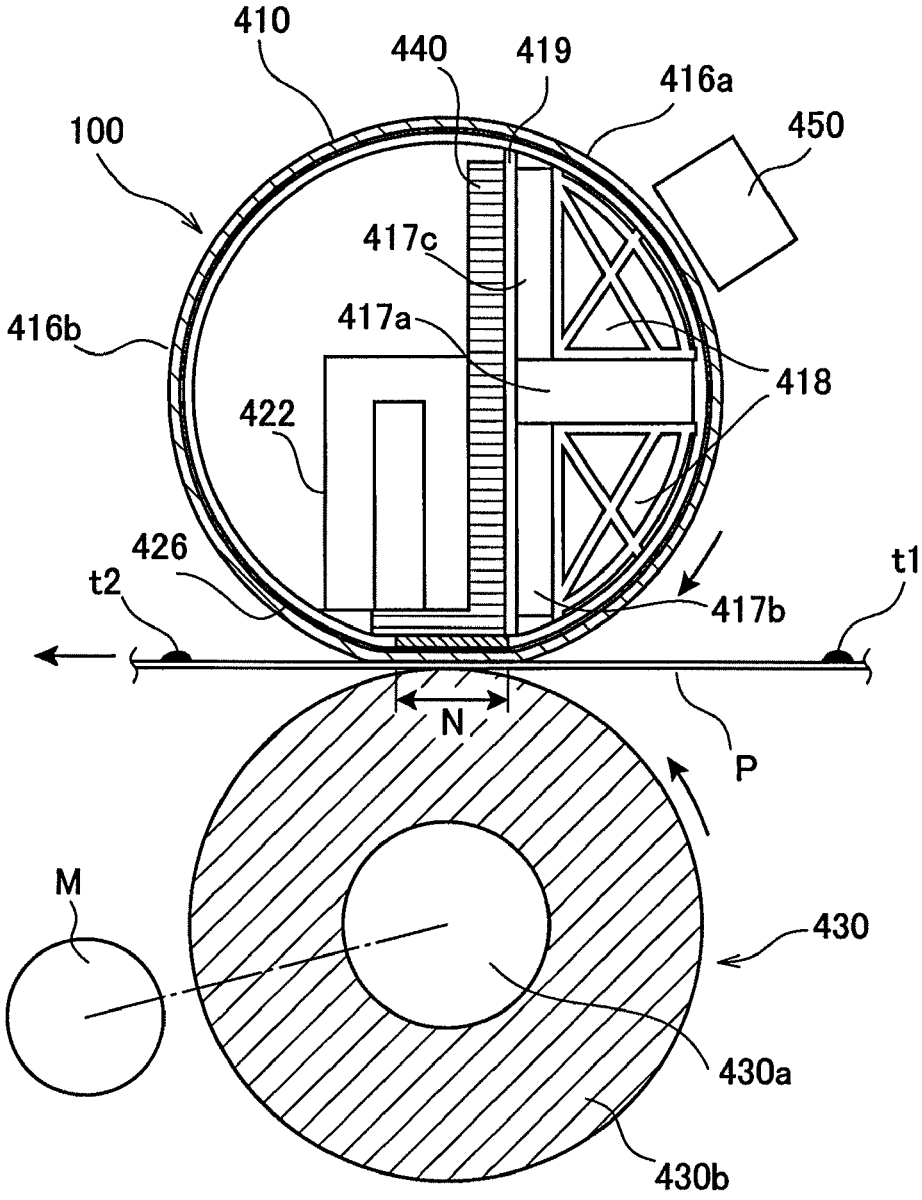
FIG. 7 is an outline schematic cross-sectional view of a heating apparatus (film type fixing apparatus).

Further, an apparatus for fixing an image with a heater through a film shown in FIG. 7 was used as a fixing unit, and was reconstructed so that the apparatus could be controlled to heat the image to a temperature of 150° C.±20° C.

In addition, the apparatus was reconstructed so as to have a process speed of 150 (mm/s).

The process cartridge filled with the toner was left to stand for 48 hours in the foregoing conditions under a high-temperature, high-humidity environment (30° C., 85% RH). After that, images each having a print percentage of 1% were continuously printed out on up to 3,000 sheets, and evaluation for the following items was performed at an initial stage and after image output on the 3,000 sheets. In addition, Table 1 shows the physical properties of the toner, and Table 2 shows the results of the evaluation.

It should be noted that the term "initial stage" as used herein refers to a time period commencing on the output of an image on the first sheet after the installation of the process cartridge in the main body of the image-forming apparatus. In addition, when print images needed for the evaluation for a series of the following items (1) to (4) are obtained, the images are regarded as initial images.

(1) Image Density

A solid image was output after printing on 3,000 sheets in an image output test by using plain paper for ordinary copying machines (75 $g/m^2$) as a transfer material, and was evaluated for its density measured as described below. It should be noted that the image density was a density measured relative to an image at a white portion having an original density of 0.00 with a "Macbeth reflection densitometer RD918" (manufactured by Macbeth Co.) in accordance with the instruction manual included with the densitometer.

A: Very good, 1.40 or more.

B: Good, 1.35 or more and less than 1.40.

C: Normal, 1.00 or more and less than 1.35.

D: Somewhat problematic, less than 1.00.

(2) Gloss Value

The gloss value of the solid image output in the above section (1) was measured with a glossmeter PG-3D (manufactured by NIPPON DENSHOKU INDUSTRIES CO., LTD.) in accordance with the instruction manual included with the glossmeter.

A: Very good, 20 or more.

B: Good, 15 or more and less than 20.

C: Normal, 10 or more and less than 15.

D: Somewhat problematic, less than 10.

(3) Circumferential Streak

After the solid image had been output in the above section (1), a developer container of the apparatus was dismantled, and the surface and edge of the toner carrying member were evaluated for circumferential streaks by visual observation. Criteria are described below.

A: No interposition of foreign matter between a toner control member of the apparatus and the toner carrying member due to the breakdown or melt adhesion of the toner occurs at the surface and edge of the toner carrying member.

B: The interposition of foreign matter between the toner carrying member and a toner edge seal is slightly observed.

C: One to four circumferential streaks resulting from the interposition of foreign matter between the toner carrying member and a toner edge seal are observed at the edge.

D: Five or more circumferential streaks resulting from the interposition of foreign matter between the toner carrying member and a toner edge seal are observed at the entire region of the toner carrying member.

(4) Image Fogging

An image having a print percentage of 30% was printed out on gloss paper according to a gloss paper mode (½ speed), and a fogging density (%) was calculated from a difference between the whiteness of the white portion of the printed-out image and the whiteness of the transfer paper each measured with a "REFLECTOMETER MODEL TC-6DS" (manufactured by Tokyo Denshoku CO., LTD.). Then, evaluation for image fogging after printing on 3,000 sheets was performed. An Amberlite filter was used for a cyan image, a blue filter was used for a yellow image, and a green filter was used for each of magenta and black images.

A: Very good, less than 0.5%.

B: Good, 0.5% or more and less than 1.0%.

C: Normal, 1.00% or more and less than 1.5%.

D: Somewhat problematic, more than 1.5%.

(5) Contamination in Main Body or Cartridge Due to Toner Scattering

The extent to which each of a cartridge of the apparatus and the periphery of the cartridge in the main body of the apparatus was contaminated with the toner after printing on 3,000 sheets was observed in order that evaluation for a balance between the charging performance and flowability of the toner might be performed.

A: Very good, the contamination of each of the cartridge and the periphery of the cartridge in the main body with the toner is not observed at all.

B: Good, the contamination of the cartridge with a trace amount of the toner is observed.

C: Normal, the contamination of each of the cartridge and the periphery of the cartridge in the main body with the toner is observed, but the contamination affects neither an image nor the fix and removal of the cartridge.

D: Somewhat problematic, each of the cartridge and the periphery of the cartridge in the main body is remarkably contaminated with the toner, and the contamination adversely affects each of an image and the fix and removal of the cartridge.

(6) Rise-Up of Charging

The evaluation for the rise-up of charging of the toner was performed on the basis of the following criteria concerning a change in density of a solid patch image printed on a twentieth sheet as compared to that of a solid patch image printed on a first sheet (measured with a Macbeth reflection densitometer).

Rank A: Very good, the sheet number of paper where the density of the image reaches 1.4 is five or less.

Rank B: Good, the sheet number of paper where the density of the image reaches 1.4 is six to ten.

Rank C: Normal, the sheet number of paper where the density of the image reaches 1.4 is eleven to twenty.

Rank D: Somewhat problematic, even the density of the image on the twentieth sheet does not reach 1.4.

(7) Transfer Uniformity

Halftone images after printing on 100 sheets and after printing on 3,000 sheets were each transferred onto a Fox River Bond paper (90 g/m$^2$) and evaluated. Criteria are described below.

A: The image shows good transfer uniformity even after the printing on the 3,000 sheets.

B: The image is slightly poor in transfer uniformity after the printing on the 3,000 sheets.

C: Images sampled after the printing on the 100 sheets and after the printing on the 3,000 sheets are each slightly poor in transfer uniformity.

D: Images sampled after the printing on the 100 sheets and after the printing on the 3,000 sheets are each considerably poor in transfer uniformity.

(8) Low-Temperature Fixability

A process cartridge filled with the toner was left to stand under a low-temperature, normal-humidity environment (10° C./50% RH) for 48 hours. After that, an unfixed image having such an image pattern that square images 10 mm on a side are evenly arranged at nine points on the entirety of transfer paper was output. A halftone image having a monochromatic toner laid-on level of 0.2 to 0.4 mg/cm$^2$ was output. Evaluation for a fixation starting temperature was performed by using the above unfixed image. It should be noted that evaluation for a fixation region was performed by using a Fox River Bond paper (90 g/m$^2$) as a paper species. The fixation starting temperature was measured by external fixation with a fixing unit which had a thermal roller free of any oil application function and having a diameter of 40 mm and the temperature of which could be controlled under a fixation condition of 150 mm/sec. It should be noted that a fluorine-based material was used in each of the upper and lower portions of the roller in this case. A nip width was 6 mm.

Judgment on the temperature at which fixation started was performed as described below. A fixed image (an image which had undergone cold offset was also permitted) was rubbed with a lens cleaning paper "Dasper(R)" (Ozu Paper Co., Ltd.) under a load of 50 g/cm$^2$, and the temperature at which the percentage by which the density of the image reduced after the rubbing as compared to that of the image before the rubbing was less than 20% was defined as a fixation starting point.

(9) Winding Performance at Low Temperatures

Whether paper wound around a fixing roller of the apparatus was visually observed, and the highest temperature at which paper was fed without winding around the roller was defined as a winding starting temperature.

(10) Storage Stability Test 10 g of an initial developer were extracted from the developing assembly. The toner was loaded into a 100-ml glass bottle, and was left to stand at 50° C. for 10 days. After that, the toner was evaluated for storage stability by visual observation.

Rank A: Very good, the toner shows no change.

Rank B: Good, the agglomerate of the toner is present, but can be readily loosened.

Rank C: Normal, the agglomerate is hardly loosened.

Rank D: Somewhat problematic, the toner shows no flowability.

Rank E: Problematic, apparent caking of the toner occurs.

Example 2

Cyan Toner No. 2 was obtained in the same manner as in Example 1 except that the amount in which the polar resin was used was changed to 40 parts. Table 1 shows the physical properties of the toner, and Table 2 shows the results of the evaluation.

Example 3

Cyan Toner No. 3 was obtained in the same manner as in Example 1 except that the amount in which the polar resin was used was changed to 10 parts. Table 1 shows the physical properties of the toner, and Table 2 shows the results of the evaluation.

Example 4

Cyan Toner No. 4 was obtained in the same manner as in Example 1 except that: 55 parts of a styrene monomer were used upon preparation of the polymerizable monomer composition 1; and 45 parts of n-butyl acrylate were used upon preparation of the polymerizable monomer composition 2. Table 1 shows the physical properties of the toner, and Table 2 shows the results of the evaluation.

Example 5

Cyan Toner No. 5 was obtained in the same manner as in Example 1 except that: 55 parts of a styrene monomer were used upon preparation of the polymerizable monomer composition 1; and 20 parts of a styrene monomer and 25 parts of n-butyl acrylate were used upon preparation of the polymerizable monomer composition 2. Table 1 shows the physical properties of the toner, and Table 2 shows the results of the evaluation.

Example 6

Cyan Toner No. 6 was obtained in the same manner as in Example 1 except that the polar resin was changed to a styrene-α-methylstyrene-methacrylic acid-methyl methacrylate copolymer (copolymerization ratio 65:30:1.5:2.5, Mp=80,000, Mw=82,000, Tg=119° C., acid value=20 mgKOH/g, Mw/Mn=2.1). Table 1 shows the physical properties of the toner, and Table 2 shows the results of the evaluation.

Example 7

Cyan Toner No. 7 was obtained in the same manner as in Example 1 except that the polar resin was changed to a styrene-n-butyl acrylate-methacrylic acid-methyl methacrylate copolymer (copolymerization ratio 84:12:1.5:2.5, Mp=15,000, Mw=16,000, Tg=81° C., acid value=20 mgKOH/g, Mw/Mn=2.1). Table 1 shows the physical properties of the toner, and Table 2 shows the results of the evaluation.

Example 8

Cyan Toner No. 8 was obtained in the same manner as in Example 1 except that the amount of calcium phosphate at the time of the production of the aqueous dispersion medium was changed to 6 parts. Table 1 shows the physical properties of the toner, and Table 2 shows the results of the evaluation.

Example 9

Cyan Toner No. 9 was obtained in the same manner as in Example 1 except that the amount of calcium phosphate at the time of the production of the aqueous dispersion medium was changed to 2 parts. Table 1 shows the physical properties of the toner, and Table 2 shows the results of the evaluation.

Example 10

Cyan Toner No. 10 was obtained in the same manner as in Example 1 except that the addition amount of the FCA1001NS (manufactured by FUJIKURA KASEI CO., LTD.) was changed to 5 parts. Table 1 shows the physical properties of the toner, and Table 2 shows the results of the evaluation.

Example 11

Cyan Toner No. 11 was obtained in the same manner as in Example 1 except that FCA1001NS (manufactured by FUJIKURA KASEI CO., LTD.) was not added. Table 1 shows the physical properties of the toner, and Table 2 shows the results of the evaluation.

Example 12

Cyan Toner No. 12 was obtained in the same manner as in Example 1 except that di-t-butyl ether (Ether Compound 1) was not added. Table 1 shows the physical properties of the toner, and Table 2 shows the results of the evaluation.

Example 13

Cyan Toner No. 13 was obtained in the same manner as in Example 1 except that the FCA1001NS (manufactured by FUJIKURA KASEI CO., LTD.) was changed to a sulfur-containing polymer 1 synthesized as described below. Table 1 shows the physical properties of the toner, and Table 2 shows the results of the evaluation.

(Production of Sulfur-Containing Polymer 1)

| | |
|---|---|
| Styrene | 100 parts by mass |
| Methyl o-styrene sulfonate | 15 parts by mass |
| 2,2'-azobisisobutyronitrile | 1.3 parts mass |
| Dimethylformamide | 110 parts by mass |

Styrene, methyl o-styrene sulfonate, and 2,2'-azobisisobutyronitrile were loaded into a reaction vessel provided with a cooling pipe, a stirring machine, a temperature gauge, and a nitrogen introducing pipe, and were dissolved in dimethylformamide. After that, the mixture was polymerized under a nitrogen atmosphere at 70° C. for 5 hours. After the completion of the reaction, the resultant was reprecipitated in 500 parts of methanol and recovered. The resultant polymer was washed with 500 parts of water twice, and was dried under reduced pressure, whereby the sulfur-containing polymer 1 containing a methyl sulfonate unit represented by a chemical formula (1) (Mw=13,200, Mw/Mn=2.6) was obtained.

[Chem 7]

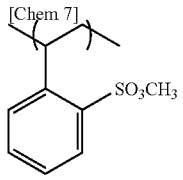

(1)

Example 14

Cyan Toner No. 14 was obtained in the same manner as in Example 1 except that di-t-butyl ether (Ether Compound 1) was changed to t-butyl isobutyl ether (Ether Compound 4). Table 1 shows the physical properties of the toner, and Table 2 shows the results of the evaluation.

Example 15

Cyan Toner No. 15 was obtained in the same manner as in Example 1 except that: 55 parts of a styrene monomer were used upon preparation of the polymerizable monomer composition 1; and 3 parts of a styrene monomer and 42 parts of n-butyl acrylate were used upon preparation of the polymerizable monomer composition 2. Table 1 shows the physical properties of the toner, and Table 2 shows the results of the evaluation.

Example 16

Cyan Toner No. 16 was obtained in the same manner as in Example 1 except that: 55 parts of a styrene monomer were used upon preparation of the polymerizable monomer composition 1; and 17 parts of a styrene monomer and 28 parts of n-butyl acrylate were used upon preparation of the polymerizable monomer composition 2. Table 1 shows the physical properties of the toner, and Table 2 shows the results of the evaluation.

Example 17

Cyan Toner No. 17 was obtained in the same manner as in Example 1 except that the polar resin was changed to a styrene-n-butyl acrylate-methacrylic acid-methyl methacrylate copolymer (copolymerization ratio 84:12:1.5:2.5, Mp=9,900, Mw=10,000, Tg=80° C., acid value=20 mgKOH/g, Mw/Mn=2.2). Table 1 shows the physical properties of the toner, and Table 2 shows the results of the evaluation.

Example 18

Cyan Toner No. 18 was obtained in the same manner as in Example 1 except that the polar resin was changed to a styrene-n-butyl acrylate-methacrylic acid-methyl methacrylate copolymer (copolymerization ratio 84:12:1.5:2.5, Mp=20,000, Mw=22,000, Tg=81° C., acid value=20 mgKOH/g, Mw/Mn=1.9). Table 1 shows the physical properties of the toner, and Table 2 shows the results of the evaluation.

Comparative Example 1

Cyan Toner No. 19 was obtained in the same manner as in Example 4 except that the polar resin was changed to 10 parts of a styrene-n-butyl acrylate-methacrylic acid-methyl methacrylate copolymer (copolymerization ratio 84:12:1.5:2.5, Mp=15,000, Mw=16,000, Tg=81° C., acid value=20 mgKOH/g, Mw/Mn=2.1). Table 1 shows the physical properties of the toner, and Table 2 shows the results of the evaluation.

Comparative Example 2

Cyan Toner No. 20 was obtained in the same manner as in Comparative Example 1 except that di-t-butyl ether (Ether Compound 1) was not added. Table 1 shows the physical properties of the toner, and Table 2 shows the results of the evaluation.

Comparative Example 3

Cyan Toner No. 21 was obtained in the same manner as in Example 5 except that: the polar resin was changed to 40 parts of a styrene-α-methylstyrene-methacrylic acid-methyl methacrylate copolymer (copolymerization ratio 65:30:1.5:2.5, Mp=80,000, Mw=82,000, Tg=119° C., acid value=20 mgKOH/g, Mw/Mn=2.1); and di-t-butyl ether (Ether Compound 1) was not added. Table 1 shows the physical properties of the toner, and Table 2 shows the results of the evaluation.

Comparative Example 4

Cyan Toner No. 22 was obtained in the same manner as in Comparative Example 3 except that 0.05 part of di-t-butyl ether (Ether Compound 1) was added. Table 1 shows the physical properties of the toner, and Table 2 shows the results of the evaluation.

Comparative Example 5

Cyan Toner No. 23 was obtained in the same manner as in Example 1 except that the polar resin was changed to 20 parts of a saturated polyester resin (produced from terephthalic acid and propylene oxide-denatured bisphenol A; Mp=9,000, Mw=8,900, Tg=72° C., acid value=12.0 mgKOH/g, Mw/Mn=2.2). Table 1 shows the physical properties of the toner, and Table 2 shows the results of the evaluation.

TABLE 1

| Toner physical properties | | | | | | | | | | | |
|---|---|---|---|---|---|---|---|---|---|---|---|
| | | Theoretical Tg of core | Polar resin | | | Sulfonic group- | Ether compound | | Weight average particle | | Viscosity at 100° C. measured with |
| Toner No. | Production method | particle (° C.) | Mp | Acid value | Tg | containing polymer | Kind | Content (ppm) | diameter (μm) | Average circularity | flow tester (Pa · s) |
| No. 1 | Suspension polymerization | 26 | 58,000 | 20 | 102 | FCA1001NS | No. 1 | 195 | 6.5 | 0.983 | 12,000 |

TABLE 1-continued

| Toner physical properties | | | | | | | | | | | |
|---|---|---|---|---|---|---|---|---|---|---|---|
| No. 2 | Suspension polymerization | 26 | 58,000 | 20 | 102 | FCA1001NS | No. 1 | 154 | 7.7 | 0.967 | 15,000 |
| No. 3 | Suspension polymerization | 26 | 58,000 | 20 | 102 | FCA1001NS | No. 1 | 246 | 5.1 | 0.991 | 6,200 |
| No. 4 | Suspension polymerization | 10 | 58,000 | 20 | 102 | FCA1001NS | No. 1 | 11 | 7.5 | 0.983 | 3,800 |
| No. 5 | Suspension polymerization | 44 | 58,000 | 20 | 102 | FCA1001NS | No. 1 | 370 | 6.8 | 0.978 | 21,000 |
| No. 6 | Suspension polymerization | 26 | 80,000 | 20 | 119 | FCA1001NS | No. 1 | 294 | 8.1 | 0.971 | 19,000 |
| No. 7 | Suspension polymerization | 26 | 15,000 | 20 | 81 | FCA1001NS | No. 1 | 102 | 5.9 | 0.989 | 5,200 |
| No. 8 | Suspension polymerization | 26 | 58,000 | 20 | 102 | FCA1001NS | No. 1 | 189 | 3.4 | 0.991 | 11,000 |
| No. 9 | Suspension polymerization | 26 | 58,000 | 20 | 102 | FCA1001NS | No. 1 | 211 | 9.2 | 0.972 | 13,500 |
| No. 10 | Suspension polymerization | 26 | 58,000 | 20 | 102 | FCA1001NS | No. 1 | 225 | 7.1 | 0.957 | 12,500 |
| No. 11 | Suspension polymerization | 26 | 58,000 | 20 | 102 | None | No. 1 | 180 | 5.3 | 0.992 | 10,500 |
| No. 12 | Suspension polymerization | 26 | 58,000 | 20 | 102 | FCA1001NS | None | 0 | 5.7 | 0.98 | 14,000 |
| No. 13 | Suspension polymerization | 26 | 58,000 | 20 | 102 | Sulfur-containing polymer | No. 1 | 175 | 6.3 | 0.981 | 11,000 |
| No. 14 | Suspension polymerization | 26 | 58,000 | 20 | 102 | FCA1001NS | No. 4 | 13 | 6.4 | 0.982 | 13,000 |
| No. 15 | Suspension polymerization | 15 | 58,000 | 20 | 102 | FCA1001NS | No. 1 | 85 | 6.4 | 0.977 | 6,000 |
| No. 16 | Suspension polymerization | 39 | 58,000 | 20 | 102 | FCA1001NS | No. 1 | 310 | 7.4 | 0.984 | 17,100 |
| No. 17 | Suspension polymerization | 26 | 9,900 | 20 | 80 | FCA1001NS | No. 1 | 78 | 5.5 | 0.991 | 4,900 |
| No. 18 | Suspension polymerization | 26 | 20,000 | 20 | 81 | FCA1001NS | No. 1 | 140 | 6.4 | 0.984 | 6,100 |
| No. 19 | Suspension polymerization | 10 | 15,000 | 20 | 81 | FCA1001NS | No. 1 | 8 | 6.1 | 0.993 | 3,500 |
| No. 20 | Suspension polymerization | 10 | 15,000 | 20 | 81 | FCA1001NS | None | 0 | 8.2 | 0.991 | 3,800 |
| No. 21 | Suspension polymerization | 44 | 80,000 | 20 | 119 | FCA1001NS | None | 0 | 7.4 | 0.961 | 29,000 |
| No. 22 | Suspension polymerization | 44 | 80,000 | 20 | 119 | FCA1001NS | No. 1 | 371 | 6.5 | 0.963 | 27,000 |
| No. 23 | Suspension polymerization | 26 | 9,000 | 12 | 72 | FCA1001NS | No. 1 | 375 | 6.2 | 0.956 | 9,800 |

| | | Dynamic viscoelastic characteristics | | | | | | | |
|---|---|---|---|---|---|---|---|---|---|
| Toner No. | Production method | T1 (° C.) | G' (T1) (dN/m$^2$) | Temperature range in which loss tangent shows a value of 0.80 to 2.00 | tanδ (120° C.-160° C.) | tanδ (T1) | T2 (° C.) | G' (T2) (dN/m$^2$) | tanδ (T2) |
| No. 1 | Suspension polymerization | 59 | $2.11 \times 10^8$ | 29° C. | 2.01-2.45 | 1.29 | 149 | $6.34 \times 10^3$ | 2.92 |
| No. 2 | Suspension polymerization | 57 | $3.56 \times 10^8$ | 15° C. | 1.78-2.16 | 0.93 | 152 | $2.55 \times 10^4$ | 2.27 |
| No. 3 | Suspension polymerization | 61 | $8.34 \times 10^7$ | 19° C. | 2.41-2.88 | 2.09 | 146 | $2.98 \times 10^3$ | 3.48 |
| No. 4 | Suspension polymerization | 52 | $5.24 \times 10^7$ | 15° C. | 2.61-3.40 | 1.99 | 144 | $1.21 \times 10^3$ | 3.93 |
| No. 5 | Suspension polymerization | 67 | $8.21 \times 10^8$ | 19° C. | 1.12-2.01 | 1.09 | 154 | $2.62 \times 10^4$ | 2.18 |
| No. 6 | Suspension polymerization | 63 | $6.79 \times 10^8$ | 27° C. | 1.04-1.49 | 1.18 | 153 | $1.08 \times 10^5$ | 1.73 |
| No. 7 | Suspension polymerization | 55 | $7.79 \times 10^7$ | 18° C. | 2.83-3.35 | 1.91 | 145 | $9.24 \times 10^2$ | 4.53 |
| No. 8 | Suspension polymerization | 59 | $1.33 \times 10^8$ | 28° C. | 2.11-2.56 | 1.31 | 149 | $5.22 \times 10^3$ | 3.15 |
| No. 9 | Suspension polymerization | 59 | $1.55 \times 10^8$ | 28° C. | 1.98-2.42 | 1.28 | 149 | $6.35 \times 10^3$ | 2.83 |
| No. 10 | Suspension polymerization | 60 | $2.46 \times 10^8$ | 29° C. | 1.89-2.23 | 1.25 | 151 | $7.11 \times 10^3$ | 2.88 |
| No. 11 | Suspension polymerization | 58 | $1.28 \times 10^8$ | 20° C. | 2.15-2.61 | 1.78 | 148 | $3.00 \times 10^3$ | 3.31 |
| No. 12 | Suspension polymerization | 59 | $8.99 \times 10^7$ | 20° C. | 2.55-3.00 | 1.87 | 150 | $2.07 \times 10^3$ | 3.73 |

TABLE 1-continued

| | | | | Toner physical properties | | | | | |
|---|---|---|---|---|---|---|---|---|---|
| No. 13 | Suspension polymerization | 59 | 1.82 × 108 | 28° C. | 2.00-2.38 | 1.27 | 149 | 6.11 × 103 | 2.9 |
| No. 14 | Suspension polymerization | 59 | 2.01 × 108 | 29° C. | 2.00-2.41 | 1.29 | 150 | 6.25 × 103 | 2.89 |
| No. 15 | Suspension polymerization | 55 | 9.98 × 107 | 21° C. | 2.29-2.84 | 1.66 | 146 | 3.21 × 103 | 3.35 |
| No. 16 | Suspension polymerization | 64 | 4.39 × 108 | 23° C. | 1.68-2.22 | 1.11 | 153 | 9.12 × 103 | 2.46 |
| No. 17 | Suspension polymerization | 54 | 7.79 × 107 | 16° C. | 2.93-3.42 | 1.93 | 143 | 8.14 × 102 | 4.57 |
| No. 18 | Suspension polymerization | 57 | 9.51 × 107 | 20° C. | 2.55-3.30 | 1.87 | 146 | 9.45 × 102 | 4.01 |
| No. 19 | Suspension polymerization | 50 | 4.91 × 107 | 15° C. | 3.51-4.49 | 2.35 | 143 | 9.00 × 102 | 4.77 |
| No. 20 | Suspension polymerization | 50 | 4.72 × 107 | 10° C. | 3.86-4.92 | 2.61 | 142 | 7.99 × 102 | 4.94 |
| No. 21 | Suspension polymerization | 68 | 1.04 × 109 | 16° C. | 1.00-1.55 | 1.05 | 155 | 1.23 × 105 | 1.69 |
| No. 22 | Suspension polymerization | 69 | 1.36 × 109 | 14° C. | 0.88-1.18 | 1.01 | 155 | 1.44 × 105 | 1.44 |
| No. 23 | Suspension polymerization | 53 | 6.15 × 107 | 14° C. | 2.55-2.99 | 2.01 | 144 | 1.85 × 103 | 3.77 |

TABLE 2

| | Results of evaluation | | | | | | | | | |
|---|---|---|---|---|---|---|---|---|---|---|
| Nonmagnetic, one-component developer | Image density | Gloss value | Circumferential streak | Fogging | Toner scattering | Rise-up of charging | Transfer uniformity | Low-temperature fixability | Winding performance at low temperatures | Storage stability |
| No. 1 | A | A | A | A | A | A | A | 130° C. | 120° C. | A |
| No. 2 | A | B | A | A | A | B | C | 140° C. | 130° C. | A |
| No. 3 | A | A | B | B | B | C | B | 130° C. | 120° C. | A |
| No. 4 | A | A | C | C | C | C | A | 130° C. | 120° C. | C |
| No. 5 | C | C | A | A | A | A | C | 150° C. | 140° C. | A |
| No. 6 | A | B | A | A | B | C | C | 140° C. | 130° C. | A |
| No. 7 | A | A | B | C | B | C | B | 130° C. | 120° C. | B |
| No. 8 | A | A | B | B | A | A | C | 130° C. | 120° C. | A |
| No. 9 | A | A | A | A | B | C | B | 130° C. | 120° C. | A |
| No. 10 | A | A | B | B | A | A | B | 130° C. | 120° C. | A |
| No. 11 | A | A | B | A | A | B | A | 130° C. | 120° C. | A |
| No. 12 | A | B | A | A | A | A | B | 140° C. | 130° C. | A |
| No. 13 | A | A | A | A | A | A | A | 130° C. | 120° C. | A |
| No. 14 | A | A | A | A | A | A | A | 130° C. | 120° C. | A |
| No. 15 | A | A | B | B | B | B | A | 130° C. | 120° C. | B |
| No. 16 | B | B | A | A | A | A | B | 140° C. | 130° C. | A |
| No. 17 | A | A | C | C | C | C | B | 130° C. | 120° C. | C |
| No. 18 | A | A | B | B | B | C | B | 130° C. | 120° C. | B |
| No. 19 | D | A | C | C | D | D | D | 130° C. | 120° C. | E |
| No. 20 | D | A | D | D | D | D | D | 130° C. | 120° C. | E |
| No. 21 | C | C | A | A | A | D | C | 160° C. | 150° C. | A |
| No. 22 | C | C | A | A | A | D | D | 170° C. | 150° C. | A |
| No. 23 | A | A | D | D | D | B | C | 130° C. | 120° C. | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-188270, filed Jul. 19, 2007, which is hereby incorporated by reference herein in its entirety.

What is claimed is:

1. A non-magnetic toner, comprising:

toner particles each containing at least a binder resin, a colorant, and a wax component; and an inorganic fine powder, wherein the toner particles have a core/shell structure; a polar resin is present in the shell; the shell has a Tg of 80°-120° C. or a peak molecular weight from 8,000 to 250,000; the core has a lower Tg or a lower peak molecular weight than the shell; and (1) when a temperature in a temperature range of 50 to 80° C. at which a loss tangent (tan) as a ratio of a loss elastic modulus (G") of the toner to a storage elastic modulus (G') of the toner shows a maximum is represented by T1, a storage elastic modulus of the toner at the temperature T1 (G'(T1)) (dN/m$^2$) satisfies a relationship of $5.00\times10^7 \leqq G'(T1) \geqq 1.00\times10^9$;

(2) a continuous temperature range with a width of 15° C. or more in which the loss tangent (tanδ) as a ratio of the loss elastic modulus (G") of the toner to the storage elastic modulus (G') of the toner is 0.80 to 2.00 is present in the temperature range of 50 to 80° C.; and (3) the loss tangent (tanδ) as a ratio of the loss elastic modulus (G") of the toner to the storage elastic modulus (G') of the toner is always 1.00 or more in a temperature range of 120 to 160° C.

2. A non-magnetic toner according to claim 1, wherein a loss tangent as a ratio of the loss elastic modulus (G") of the toner to the storage elastic modulus (G') of the toner at the temperature T1 (tanδ(T1)) satisfies a relationship of $1.00 \leqq \tan\delta(T1) \leqq 2.00$.

3. A non-magnetic toner according to claim 1, wherein, when a temperature in the temperature range of 120 to 160° C. at which the loss tangent (tanδ) as a ratio of the loss elastic modulus (G") of the toner to the storage elastic modulus (G') of the toner shows a maximum is represented by T2, a loss tangent of the toner at the temperature T2 (tanδ(T2)) satisfies a relationship of $1.50 \leqq \tan\delta(T2) \leqq 4.50$, and a storage elastic modulus of the toner at the temperature T2(G'(T2)) (dN/m2) satisfies a relationship of $1.00\times10^3 \leqq G'(T2) \leqq 1.00\times10^5$.

4. A non-magnetic toner according to claim 1, wherein a melt viscosity of the toner at 100° C. measured with a flow tester is $5.00\times10^3$ to $2.00\times10^4$ Pa·s.

5. A non-magnetic toner according to claim 1, wherein the toner particles each contain a polymer or copolymer containing a sulfonic group, a sulfonate group, or a sulfonic acid ester group.

6. A non-magnetic toner according to claim 1, further comprising a compound represented by the following structural formula (1) or (2):

[Chem 1]

(1)

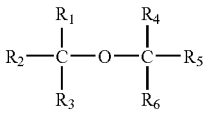

where $R_1$ to $R_6$ each represent an alkyl group having 1 to 6 carbon atoms, and may be identical to or different from one another, and

[Chem 2]

(2)

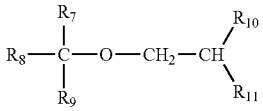

where $R_7$ to $R_{11}$ each represent an alkyl group having 1 to 6 carbon atoms, and may be identical to or different from one another.

7. A non-magnetic toner according to claim 1, wherein the toner has an average circularity measured with a flow-type particle image analyzer of 0.960 to 0.995 and a weight average particle diameter (D4) of 4.0 to 9.0 μm.

8. A non-magnetic toner according to claim 1, wherein the inorganic fine powder has an average primary particle diameter of 4 to 80 nm, and is added in an amount of 0.1 to 4.0 parts by mass with respect to 100 parts by mass of the toner particles.

9. A non-magnetic toner according to claim 1, wherein the toner particles are produced through a granulating step in an aqueous medium.

10. A non-magnetic toner according to claim 9, wherein the toner particles are produced by a suspension polymerization method.

* * * * *